US012116655B2

(12) United States Patent
Volbers et al.

(10) Patent No.: US 12,116,655 B2
(45) Date of Patent: Oct. 15, 2024

(54) SOFT MAGNETIC ALLOY AND METHOD FOR PRODUCING A SOFT MAGNETIC ALLOY

(71) Applicant: Vacuumschmelze GmbH & Co. KG, Hanau (DE)

(72) Inventors: Niklas Volbers, Hanau (DE); Johannes Tenbrink, Hanau (DE); Jan Frederik Fohr, Hanau (DE)

(73) Assignee: VACUUMSCHMELZE GMBH & CO. KG, Hanau (DE)

( * ) Notice: Subject to any disclaimer, the term of this patent is extended or adjusted under 35 U.S.C. 154(b) by 0 days.

(21) Appl. No.: 17/554,239

(22) Filed: Dec. 17, 2021

(65) Prior Publication Data

US 2022/0195568 A1 Jun. 23, 2022

(30) Foreign Application Priority Data

Dec. 18, 2020 (DE) ..... 102020134301.9

(51) Int. Cl.

| | |
|---|---|
| ***C21D 8/12*** | (2006.01) |
| ***C22C 38/02*** | (2006.01) |
| ***C22C 38/10*** | (2006.01) |
| ***C22C 38/12*** | (2006.01) |
| ***C22C 38/18*** | (2006.01) |
| ***C23C 28/04*** | (2006.01) |

(52) U.S. Cl.

CPC ..... *C22C 38/10* (2013.01); *C21D 8/1272* (2013.01); *C21D 8/1283* (2013.01); *C22C 38/02* (2013.01); *C22C 38/12* (2013.01); *C22C 38/18* (2013.01); *C23C 28/042* (2013.01); *C21D 2201/05* (2013.01); *C22C 2202/02* (2013.01)

(58) Field of Classification Search

CPC ..... C22C 38/10

See application file for complete search history.

(56) References Cited

U.S. PATENT DOCUMENTS

| | | | |
|---|---|---|---|
| 1,862,559 | A | 6/1932 | White et al. |
| 2,717,223 | A | 9/1955 | Binstock et al. |
| 2,992,952 | A | 7/1961 | Assmus et al. |
| 3,065,118 | A | 11/1962 | Wawrousek et al. |
| 3,078,198 | A | 2/1963 | Wiener |

(Continued)

FOREIGN PATENT DOCUMENTS

| | | | |
|---|---|---|---|
| DE | 1029845 | B | 5/1958 |
| DE | 1049409 | B | 1/1959 |

(Continued)

OTHER PUBLICATIONS

Aspden, R.G. et al., "Anisotropic And Heterogeneous Nucleation During The Gamma To Alpha Transformation In Iron," Acta Metallurgica, vol. 16, Aug. 1968, 9 pages.

(Continued)

*Primary Examiner* — Jophy S. Koshy
(74) *Attorney, Agent, or Firm* — Dickinson Wright PLLC

(57) ABSTRACT

A soft magnetic alloy comprising 2 wt %≤Co≤30 wt %, 0.3 wt %≤V≤5.0 wt % and iron is provided. The soft magnetic alloy has a area proportion of a {111}<uvw> texture of no more than 13%, preferably no more than 6%, including grains with a tilt of up to +/−10°, or preferably of up to +/−15°, when compared to the nominal crystal orientation.

16 Claims, 12 Drawing Sheets

(56) References Cited

U.S. PATENT DOCUMENTS

| | | | | |
|---|---|---|---|---|
| 3,148,092 | A | 9/1964 | Shull, Jr. | |
| 3,166,408 | A | 1/1965 | Chen | |
| 3,240,638 | A | 3/1966 | Wiener et al. | |
| 3,282,747 | A | 11/1966 | Foster et al. | |
| 3,466,201 | A | 9/1969 | Assmus et al. | |
| 3,597,286 | A | 8/1971 | Thornburg | |
| 3,634,072 | A | 1/1972 | Ackermann et al. | |
| 3,695,944 | A | 10/1972 | Stroble | |
| 3,856,568 | A | 12/1974 | Tanaka et al. | |
| 3,868,278 | A | 2/1975 | Foster et al. | |
| 3,977,919 | A | 8/1976 | Foster et al. | |
| 4,367,100 | A | 1/1983 | Miller, Jr. | |
| 4,537,792 | A | 8/1985 | Kitayama et al. | |
| 5,174,833 | A * | 12/1992 | Tanaka | C21D 8/1283 427/127 |
| 5,394,721 | A | 3/1995 | Iwayama et al. | |
| 5,507,883 | A | 4/1996 | Tanaka et al. | |
| 5,685,920 | A | 11/1997 | Tanaka et al. | |
| 6,146,474 | A | 11/2000 | Coutu et al. | |
| 6,423,156 | B1 | 7/2002 | Günther et al. | |
| 6,685,882 | B2 | 2/2004 | Deevi et al. | |
| 7,905,965 | B2 | 3/2011 | Gigliotti et al. | |
| 8,943,677 | B2 | 2/2015 | Gerster et al. | |
| 10,742,077 | B2 | 8/2020 | Volbers | |
| 2004/0126483 | A1 | 7/2004 | Heimann et al. | |
| 2005/0268994 | A1 | 12/2005 | Gerster et al. | |
| 2008/0121315 | A1 | 5/2008 | Gigliotti et al. | |
| 2011/0050376 | A1 | 3/2011 | Gerster et al. | |
| 2012/0156441 | A1 | 6/2012 | Gerster et al. | |
| 2017/0162295 | A1 | 6/2017 | Sashi et al. | |
| 2018/0223401 | A1 | 8/2018 | Waeckerle et al. | |
| 2019/0360065 | A1 | 11/2019 | Volbers et al. | |
| 2020/0299820 | A1 | 9/2020 | Volbers | |
| 2020/0318212 | A1 * | 10/2020 | Fohr | C22C 38/42 |
| 2020/0325564 | A1 | 10/2020 | Fohr et al. | |
| 2022/0074011 | A1 | 3/2022 | Han et al. | |
| 2022/0199304 | A1 * | 6/2022 | Volbers | C22C 38/42 |

FOREIGN PATENT DOCUMENTS

| | | | | |
|---|---|---|---|---|
| DE | 1101471 | B | 3/1961 | |
| DE | 1106354 | B | 5/1961 | |
| DE | 1109197 | B | 6/1961 | |
| DE | 1115279 | B | 10/1961 | |
| DE | 1180954 | B | 11/1964 | |
| DE | 1483516 | A1 | 2/1969 | |
| DE | 2129930 | A1 | 12/1971 | |
| DE | 2247269 | A1 | 4/1973 | |
| DE | 3336448 | A1 | 4/1984 | |
| DE | 19754996 | A1 | 6/1999 | |
| DE | 19750066 | C1 | 8/1999 | |
| DE | 102009038730 | A1 | 1/2010 | |
| DE | 102008039326 | A1 | 2/2010 | |
| DE | 102012105605 | A1 | 1/2013 | |
| DE | 102018112491 | A1 | 5/2019 | |
| DE | 102019107422 | A1 | 9/2020 | |
| EP | 0695812 | A1 | 2/1996 | |
| EP | 0824755 | B1 | 1/2001 | |
| EP | 0935008 | B1 | 10/2002 | |
| EP | 1145259 | B1 | 12/2002 | |
| EP | 1482072 | A2 | 12/2004 | |
| EP | 1475450 | B1 | 11/2005 | |
| EP | 2791377 | B1 | 7/2018 | |
| EP | 3396022 | A1 | 10/2018 | |
| EP | 3396681 | A1 | 10/2018 | |
| EP | 3541969 | A1 | 9/2019 | |
| GB | 2207927 | B | 2/1991 | |
| GB | 2492406 | A | 1/2013 | |
| GB | 2495465 | A | 4/2013 | |
| GB | 2550593 | A | 11/2017 | |
| JP | S6240344 | A | 2/1987 | |
| WO | 00/05733 | A2 | 2/2000 | |
| WO | WO-0100895 | A1 * | 1/2001 | C21D 6/007 |
| WO | 2013/125790 | A1 | 8/2013 | |
| WO | 2014/180610 | A1 | 11/2014 | |
| WO | 2018/091169 | A1 | 5/2018 | |
| WO | 2018091694 | A1 | 5/2018 | |
| WO | 2020130643 | A1 | 6/2020 | |

OTHER PUBLICATIONS

Krause, R.F. et al., "Magnetic properties of textured annealed commercial black plate," J. Appl. Phys., vol. 52, No. 3, Mar. 1981, 3 pages.

Sung, Jin Kyung et al., "Efficient Generation of Cube-on-Face Crystallographic Texture in Iron and its Alloys," ISIJ International, vol. 51, No. 2, 2011, 7 pages.

* cited by examiner

A: as-rolled

B: annealed in α-region
(in powder or free hanging)

C: annealedin γ- region
(with powder)

D: annealed in γ-region
(no powder, free hanging)

A: as-rolled

B: annealed in $\alpha$-region
(in powder or free hanging)

C: annealed in $\gamma$-region
(with powder)

D: annealed in $\gamma$-region
( no powder one sided nano-Böhmite coated, Test B, annealed

SOFT MAGNETIC ALLOY AND METHOD FOR PRODUCING A SOFT MAGNETIC ALLOY

This U.S. patent application claims priority to DE Patent Application No. 10 2020 134 301.9, filed Dec. 18, 2020, the entire contents of which is incorporated herein by reference in its entirety.

BACKGROUND

1. Technical Field

The invention relates to a soft magnetic alloy and a method for producing a soft magnetic alloy.

2. Related Art

Soft magnetic cobalt-iron (CoFe) alloys are used in electric machines, amongst other devices, owing to their excellent saturation induction. Commercially available CoFe alloys typically have a composition of 49 wt % Fe, 49 wt % Co and 2 wt % V. With a composition of this type, a saturation induction of approx. 2.35 T and a high electrical resistance of 0.4 μΩm are achieved simultaneously. Owing to their high permeability, these alloys can be used in applications such as rotors and stators of electric motors in order to reduce rotor/stator and so electric motor size and/or to increase output when compared with FeSi alloys. This makes it possible to generate higher torque at identical size and/or identical weight, for example, which would be advantageous for use in electric or hybrid motor vehicles.

DE 10 2018 112 491 A1 discloses a highly permeable soft magnetic FeCo alloy with 5 to 25 wt % Co, that can have a maximum permeability of more than 17,000 and lower hysteresis losses. Owing to the lower Co content, the raw materials costs of this alloy are lower than those of an alloy based on 49 wt % Fe, 49 wt % Co and 2% V. At the same time, this alloy has no significant ordering and can therefore, in contrast to alloys containing more than 30 wt % Co, be cold rolled without first undergoing a quenching process. This serves to simplify industrial-scale production.

However, it is desirable to be able to achieve these good magnetic properties more reliably, in particular in industrial-scale production.

SUMMARY

The object is therefore to provide a soft magnetic CoFe alloy that has a lower Co content and good magnetic properties, and can be produced more reliably in industrial-scale production processes.

According to the invention a method is provided for producing a soft magnetic alloy comprising the following. A preliminary product is provided, having a composition that consists essentially of:

2 wt %≤Co≤30 wt %
0.3 wt %≤V≤5.0 wt %
0 wt %≤Cr≤3.0 wt %
0 wt %≤Si≤5.0 wt %
0 wt %≤Mn≤5.0 wt %
0 wt %≤Al≤3.0 wt %
0 wt %≤Ta≤0.5 wt %
0 wt %≤Ni≤1.0 wt %
0 wt %≤Mo≤0.5 wt %
0 wt %≤Cu≤0.2 wt %
0 wt %≤Nb≤0.25 wt %

0 wt %≤Ti≤0.05 wt %
0 wt %≤Ce≤0.05 wt %
0 wt %≤Ca≤0.05 wt %
0 wt %≤Mg≤0.05 wt %
0 wt %≤C≤0.02 wt %
0 wt %≤Zr≤0.1 wt %
0 wt %≤O≤0.025 wt %
0 wt %≤S≤0.015 wt % the rest iron and up to 0.2 wt % of other impurities due to melting. The preliminary product has a phase transition from a BCC-phase region to a mixed BCC/FCC region to an FCC-phase region. As the temperature increases, the phase transition between the BCC-phase region and the mixed BCC/FCC region occurs at a first transition temperature $T_{\alpha/\alpha+\gamma}$ and, as the temperature increases further, the transition between the mixed BCC/FCC region and the FCC-phase region occurs at a second transition temperature $T_{\alpha+\gamma/\gamma}$, wherein $T_{\alpha+\gamma/\gamma}>T_{\alpha/\alpha+\gamma}$.

In some embodiments, the difference $T_{\alpha+\gamma/\gamma}-T_{\alpha/\alpha+\gamma}$ being less than 45K, preferably less than 25K.

Other impurities include, for example, B, P, N, W, Hf, Y, Re, Sc, Be and other lanthanides except Ce.

This preliminary product is partially coated with a ceramic-forming layer, 20% to 80% of the total surface area of the preliminary product remaining free of the ceramic-forming layer. The partially coated preliminary product is then heat treated. This heat treatment is also described as final annealing because the mechanical forming steps, hot and/or cold rolling, for example, used to produce the preliminary product having been completed and the preliminary product does not therefore undergo any further mechanical deformation, e.g. rolling, following heat treatment.

In some embodiments, the preliminary product has a planar form having a first surface and a second surface opposing the first surface. The planar preliminary product may have the form of a strip, a sheet, a lamination or a lamination having its end contour. At least between 20% and 80%, preferably between 30% and 70%, particularly preferably between 50% and 70% of the first surface and between 20% and 80%, preferably between 30% and 70%, particularly preferably between 50% and 70% of the second surface remains free of the ceramic-forming layer, In one embodiment the heat treatment comprises the following:

heating up the preliminary product, and then
heat treating the preliminary product in a first step for a total time $t_1$, in this first step the preliminary product being heat treated at a temperature within a temperature range of $T_{\alpha+\gamma/\gamma}$ to $T_1$, and then
cooling the preliminary product to room temperature, $T_1$ being above $T_{\alpha+\gamma/\gamma}$ and $t_1$ referring to the total time at temperatures above $T_{\alpha+\gamma/\gamma}$.

In an alternative embodiment the heat treatment comprises the following:

heating up the preliminary product, and then
heat treating the preliminary product in a first step for a total time $t_1$, in this first step the preliminary product being heat treated at a temperature within a temperature range of $T_{\alpha+\gamma/\gamma}$ to $T_1$, and then
cooling the preliminary product to a temperature $T_2$, and immediately thereafter
heat treating the preliminary product in a second step at temperature $T_2$ for a time $t_2$, and then
cooling the preliminary product to room temperature, with $T_1>T_2$, $T_1$ being above $T_{\alpha+\gamma/\gamma}$, $T_2$ being below $T_{\alpha/\alpha+\gamma}$, and $t_1$ referring to the total time at temperatures is above $T_{\alpha+\gamma/\gamma}$.

In both embodiments the heat treatment is carried out at least partially in a hydrogen-containing atmosphere, the exposed parts of the surface of the preliminary product being in direct contact with the hydrogen-containing atmosphere. At least partially refers to time so that the heat treatment may be carried out over a time period in a hydrogen-containing atmosphere that is less than the entire time period of the heat treatment or during the entire time period of the heat treatment.

The temperature $T_1$ indicates a temperature at which the soft magnetic alloy is in the FCC-phase region and temperature $T_2$ indicates a temperature at which the soft magnetic alloy is in the BCC-phase region. The actual temperature of the furnace may deviate from the $T_1$ or $T_2$ value, and $T_1$ thus includes temperatures $T_1$ with a maximum deviation of +/−20° C. that lie above $T_{\alpha+\gamma/\gamma}$ while $T_2$ includes temperatures $T_2$ with a maximum deviation of +/−20° C. that lie below $T_{\alpha/\alpha+\gamma}$.

In industrial-scale production a plurality of preliminary products is customarily heat treated at the same time. These preliminary products are customarily coated with a ceramic layer so that they do not fuse together during heat treatment. Preliminary products in the form of strips or sheets, for example, are stacked one on top of another and then heat treated. A ceramic layer is typically arranged between the strips or sheets to prevent them from fusing together.

Surprisingly, it has been found that when these alloys are heat treated at temperatures above transition temperature $T_{\alpha+\gamma/\gamma}$, and thus in the FCC- or γ-phase region, their magnetic properties are dependent on the proportion or fraction of the surface of the preliminary product that is exposed. If a proportion of fraction of the preliminary product is at least partially in direct contact with the hydrogen-containing atmosphere during heat treatment, good magnetic properties can be more reliably achieved even in large batches. However, it has also been found that the magnetic properties are less good when the surface is completely covered with the ceramic layer, even though this covering is advantageous in avoiding the risk of the preliminary products fusing together. It has been established that good magnetic properties correlate with the formation of a texture in the soft magnetic alloy and that the formation of this texture depends on the fraction or proportion of the exposed surface that is in direct contact with a hydrogen-containing atmosphere during final annealing.

Consequently, the preliminary product is only partially coated with the ceramic-forming layer, which transforms into a ceramic layer during the subsequent heat treatment. The coating applied may, for example, comprise a sol with ceramic nanoparticles distributed in an organic matrix, or may comprise metal ions of a metal oxide or metal hydroxide, such that in the as-applied form no ceramic layer is yet present. The ceramic layer formed during heat treatment may also contain a metal oxide and/or a metal hydroxide and covers only part of the surface.

In some embodiments the preliminary product takes the form of a sheet having a first surface and a second, opposite surface, at least between 20% and 80%, preferably between 30% and 70%, particularly preferably between 50% and 70%, of the first surface and between 20% and 80%, preferably between 30% and 70%, particularly preferably between 50% and 70%, of the second surface remaining free of the ceramic-forming layer.

In one embodiment the composition is further defined and consists essentially of:

| | | | | |
|---|---|---|---|---|
| 5 wt % | ≤ | Co | ≤ | 25 wt % |
| 0.3 wt % | ≤ | V | ≤ | 5.0 wt % |
| 0 wt % | ≤ | Cr | ≤ | 3.0 wt % |
| 0 wt % | ≤ | Si | ≤ | 3.0 wt % |
| 0 wt % | ≤ | Mn | ≤ | 3.0 wt % |
| 0 wt % | ≤ | Al | ≤ | 3.0 wt % |
| 0 wt % | ≤ | Ta | ≤ | 0.5 wt % |
| 0 wt % | ≤ | Ni | ≤ | 0.5 wt % |
| 0 wt % | ≤ | Mo | ≤ | 0.5 wt % |
| 0 wt % | ≤ | Cu | ≤ | 0.2 wt % |
| 0 wt % | ≤ | Nb | ≤ | 0.25 wt % |
| 0 wt % | ≤ | Ti | ≤ | 0.05 wt % |
| 0 wt % | ≤ | Ce | ≤ | 0.05 wt % |
| 0 wt % | ≤ | Ca | ≤ | 0.05 wt % |
| 0 wt % | ≤ | Mg | ≤ | 0.05 wt % |
| 0 wt % | ≤ | C | ≤ | 0.02 wt % |
| 0 wt % | ≤ | Zr | ≤ | 0.1 wt % |
| 0 wt % | ≤ | O | ≤ | 0.025 wt % |
| 0 wt % | ≤ | S | ≤ | 0.015 wt % |

and the rest iron, where Cr+Si+Al+Mn≤3.0 wt %, and up to 0.2 wt % of other impurities due to melting. Other impurities include, for example, B, P, N, W, Hf, Y, Re, Sc, Be and other lanthanides except Ce.

In some embodiments the ceramic-forming layer is applied to the preliminary product in the form of a structure. This structure may take the form of a pattern of stripes or dots, or a network or a mesh. The ceramic-forming layer may be applied selectively to the surface of the preliminary product by means of printing or profile printing or profile rolling, for example. Alternatively, it is possible to first place a mask with openings on the surfaces, to apply the ceramic-forming layer over the entire surface and then to remove the mask so that only those parts of the surface exposed by the openings in the mask are coated.

In some embodiments the maximum width of the coated regions is less than 2 mm, preferably less than 1.2 mm, particularly preferably less than 0.8 mm. It has been found that magnetic properties can be achieved more reliably if the area of the coated parts is limited.

In some embodiments the preliminary product takes the form of a strip. The structured coating may be applied to one or both sides of the strip.

In some embodiments between 30% and 70%, preferably between 50 and 70%, of the total surface of the preliminary product remains free of the ceramic-forming layer.

In some embodiments after heat treatment the ceramic layer formed contains a hydrated metal oxide and/or a metal oxide and/or a metal hydroxide.

In some embodiments in addition to the partial coating or instead of the partial coating the preliminary product is covered with a ceramic powder, a ceramic sheet, or a metal sheet during heat treatment. The ceramic powder may contain $Al_2O_3$ or MgO or $ZrO_2$ or a mixture of $ZrO_2$, $SiO_2$ and $Al_2O_3$. The ceramic sheet may contain $Al_2O_3$ or MgO or $ZrO_2$ or a mixture of $ZrO_2$, $SiO_2$ and $Al_2O_3$.

A ceramic sheet or a metal sheet may be used to ensure the planarity of preliminary products in the form of sheets or strips or stacks of sheets or strips.

It has also been found that a covering of ceramic powder alone, i.e. without the partial coating of the preliminary product, also allows the surface to be in direct contact with the hydrogen-containing atmosphere and so makes it possible to achieve a texture and good magnetic properties. However, a covering of ceramic powder alone is not as practical in industrial-scale commercial production.

Surprisingly, it has been found that contact with the hydrogen-containing atmosphere has a greater impact on texture formation and magnetic properties during the cooling phase of final annealing than during the heating phase or the first annealing step above $T_{\alpha+\gamma/\gamma}$. In particular, it has been found that the use of a hydrogen-containing atmosphere with more than 5 vol. % hydrogen during cooling above a temperature range from $T_{\alpha+\gamma/\gamma}$ to $T_{\alpha/\alpha+\gamma}$ is advantageous for setting soft magnetic properties.

In some embodiments during the heating of the preliminary product at least in a temperature range from $T_{\alpha/\alpha+\gamma}$ to $T_1$ heat treatment takes place in an protective gas 1*o* atmosphere containing less than 5 vol. % hydrogen, preferably less than 1 vol. % hydrogen, and cooling from $T_1$ takes place at least in a temperature range from $T_{\alpha+\gamma/\gamma}$ to $T_{\alpha/\alpha+\gamma}$ in a hydrogen-containing atmosphere containing more than 5 vol. % hydrogen. This embodiment can also be used with a completely uncoated preliminary product.

In some embodiments after the cooling of the preliminary product to a temperature $T_2$, where $T_2$ is below $T_{\alpha/\alpha+\gamma}$, the preliminary product is held at a temperature $T_2$ for a time $t_2$ and only then cooled further.

In some embodiments the heat treatment of the preliminary product in the first step is carried out for the total time $t_1$ in an protective gas atmosphere containing less than 5 vol. % hydrogen, preferably less than 1 vol. % hydrogen.

In some embodiments the cooling of the preliminary product from $T_1$ to $T_2$ is carried out in a hydrogen-containing atmosphere containing more than 5 vol. % hydrogen.

In some embodiments the cooling of the preliminary product from $T_1$ to room temperature is carried out in a hydrogen-containing atmosphere containing more than 5 vol. % hydrogen.

Argon or nitrogen alone or a mixture of argon or nitrogen containing less than 5 vol. % hydrogen can be used as the protective gas.

In some embodiments the hydrogen-containing atmosphere containing more than 5 vol. % hydrogen has an initial saturation point of less than −40° C.

In some embodiments the hydrogen-containing atmosphere containing more than 5 vol. % hydrogen also contains argon.

In some embodiments the following values apply: $T_{\alpha+\gamma/\gamma} \leq T_1 \leq T_{\alpha+\gamma/\gamma}+50°$ C. and 15 minutes$\leq t_1 \leq$10 hours, preferably 15 minutes$\leq t_1 \leq$4 hours and 700° C.$\leq T_2 \leq$1050° C. and 30 minutes$\leq t_2 \leq$20 hours.

In some embodiments the heat treatment also comprises a subsequent second final annealing in a hydrogen-containing protective gas atmosphere at a maximum temperature below the first transition temperature $T_{\alpha/\alpha+\gamma}$.

An ideal soft magnetic material has no preferred magnetic direction. As soon as there is a preferred direction, magnetisation processes are hampered because additional energy is required to turn the magnetic moments out of the preferred direction. In crystalline soft magnetic materials this direction-dependent energy is referred to as magnetocrystalline anisotropic energy. Owing to the symmetric relations in a cubic crystal system, magnetocrystalline anisotropic energy is expressed as a series expansion with a first-order coefficient referred to as the anisotropy constant $K_1$.

FeCo alloys have a preferred magnetic direction that influences their magnetic properties. In FeCo alloys with Co contents of below 42 wt %, the cube edges <100> are the magnetically soft axes, while the body diagonals <111> represent the magnetically hard axes. The face diagonals <110> have average soft magnetic properties.

In applications for transformers, stators and rotors soft magnetic materials in the form of thin sheets are used to reduce the formation of eddy currents during remagnetisation. For applications of this type it is therefore advantageous for the magnetically favourable cube edges <100> to lie in the plane of the sheet wherever possible and for the magnetically unfavourable orientations <111> not to lie in the sheet plane wherever possible.

A preferred orientation of the crystal orientation in a polycrystal material is referred to as a texture. In the cube face texture, the cube faces {001} also lie in the sheet plane, but rather than being set the orientation of the cube edges varies equally between rolling direction and the direction transverse to rolling direction. The cube face texture is therefore described by {100}<uvw>. This results in clearly more homogenous magnetic properties. In principle, therefore, this texture represents the best variant for applications for stators and rotors, at least for the alloys considered here in which $K_1$ is always greater than zero.

Surprisingly, it has been established that in practice the formation of {111}<uvw> texture has a major influence on magnetic properties and thus that the fraction or proportion of this texture should be reduced in order to achieve good magnetic properties reliably. A higher fraction of {100}<uvw> texture alone does not lead to the best magnetic properties if the fraction of {111}<uvw> texture is also too high. Surprisingly, it has been found that the fraction of {111}<uvw> texture is reduced by the method according to the invention, i.e. the use of final annealing carried out for certain periods in the FCC-phase region, partial covering of the surface and annealing in hydrogen for certain periods leads to the suppression of the formation of {111}<uvw> texture.

In some embodiments, after heat treatment the alloy has a area proportion of a {111}<uvw> texture of no more than 13%, preferably no more than 6%, including grains with a tilt of up to +/−10°, or even better up to +/−15°, when compared to the nominal crystal orientation of the {111} planes.

In some embodiments, after heat treatment the alloy has a area proportion of a {100}<uvw> cube face texture of at least 30%, preferably at least 50%, including grains with a tilt of up to +/−15,° or even better up to +/−10°, when compared to the nominal crystal orientation of the {100} planes.

In some embodiments the heating rate over a temperature range of at least $T_{\alpha+\gamma/\gamma}$ to $T_{\alpha/\alpha+\gamma}$, preferably 900° C. to $T_1$, is 10 K/h to 1000 K/h, preferably 20 K/h to 100 K/h.

In some embodiments the cooling rate over a temperature range of at least $T_{\alpha/\alpha+\gamma}$ to $T_{\alpha+\gamma/\gamma}$, preferably $T_1$ to 900° C., is 10K/h to 200 K/h and preferably 20K/h to 100 K/h.

In some embodiments the preliminary product is weighted down with an additional weight and both preliminary product and weight are subjected to the heat treatment.

In some embodiments the weighting-down weight represents at least 10%, preferably at least 30%, of the weight of the preliminary product.

In some embodiments, after heat treatment the preliminary product is subjected to further heat treatment in an atmosphere containing oxygen or water vapour in order to form the electrically insulating layer.

In some embodiments the preliminary product takes the form of a plurality of stacked metal sheets, or one or more laminations having final-contour, which may or may not be stacked, or one or more laminated cores. If it takes the form of a plurality of stacked metal sheets, in some embodiments after heat treatment at least one laminated core is manufactured from the stacked metal sheets by means of electric discharge machining, laser cutting or water jet-cutting.

If the preliminary product takes the form of final-contour laminations, after heat treatment the laminations are stuck together by means of an insulating adhesive to form a laminated core, or surface-oxidised to provide an insulating layer and then stuck or laser welded together to form a laminated core, or coated with a hybrid inorganic-organic coating and then processed further to form a laminated core by means of stacking and sticking or laser welding, for example.

If the preliminary product takes the form of sheets, after heat treatment the sheets may be stuck together by means of an insulating adhesive, or surface-oxidised to provide an insulating layer and then stuck or laser welded together, or coated with a hybrid inorganic-organic coating and then processed further by means of stacking and sticking or laser welding, for example. The laminated core may be then be cut from the stack of sheets.

In some embodiments, after heat treatment the soft magnetic alloy has a maximum permeability $\mu_{max} \geq 6{,}000$ and/or an electrical resistance $\rho \geq 0.25$ μΩm, hysteresis losses $P_{Hys} \leq 0.07$ J/kg at an amplitude of 1.5 T and/or a coercive field strength $H_c$ of ≤0.8 A/cm and/or an induction $B_{20} \geq 1.70$ T at 20 A/cm.

In some embodiments, after heat treatment the soft magnetic alloy has a maximum permeability $\mu_{max} \geq 10{,}000$ and/or an electrical resistance $\rho \geq 0.25$ μΩm and/or hysteresis losses $P_{Hys} \leq 0.06$ J/kg at an amplitude of 1.5 T and/or a coercive field strength $H_c$ von≤0.5 A/cm and an induction $B_{20} \geq 1.74$ T at 20 A/cm.

In some embodiments, after heat treatment the average grain size of soft magnetic alloy is at least 100 μm, preferably at least 200 μm, particularly preferably at least 250 μm.

In some embodiments, after heat treatment the average grain size of the soft magnetic alloy is 1.0 to 2.0 times, preferably 1.0 to 1.5 times the strip thickness.

According to the invention, a soft magnetic alloy that consists essentially of:

| | | | | |
|---|---|---|---|---|
| 2 wt % | ≤ | Co | ≤ | 30 wt % |
| 0.3 wt % | ≤ | V | ≤ | 5.0 wt % |
| 0 wt % | ≤ | Cr | ≤ | 3.0 wt % |
| 0 wt % | ≤ | Si | ≤ | 5.0 wt % |
| 0 wt % | ≤ | Mn | ≤ | 5.0 wt % |
| 0 wt % | ≤ | Al | ≤ | 3.0 wt % |
| 0 wt % | ≤ | Ta | ≤ | 0.5 wt % |
| 0 wt % | ≤ | Ni | ≤ | 1.0 wt % |
| 0 wt % | ≤ | Mo | ≤ | 0.5 wt % |
| 0 wt % | ≤ | Cu | ≤ | 0.2 wt % |
| 0 wt % | ≤ | Nb | ≤ | 0.25 wt % |
| 0 wt % | ≤ | Ti | ≤ | 0.05 wt % |
| 0 wt % | ≤ | Ce | ≤ | 0.05 wt % |
| 0 wt % | ≤ | Ca | ≤ | 0.05 wt % |
| 0 wt % | ≤ | Mg | ≤ | 0.05 wt % |
| 0 wt % | ≤ | C | ≤ | 0.02 wt % |
| 0 wt % | ≤ | Zr | ≤ | 0.1 wt % |
| 0 wt % | ≤ | O | ≤ | 0.025 wt % |
| 0 wt % | ≤ | S | ≤ | 0.015 wt % |

the rest iron and up to 0.2 wt % of other impurities due to melting is also provided. The soft magnetic alloy also has a area proportion of a {111}<uvw> texture of no more than 13%, preferably no more than 6%, including grains with a tilt of up to +/−10°, or preferably up to +/−15°, when compared to the nominal crystal orientation.

The combination of this composition and texture makes it possible to ensure the magnetic properties of the soft magnetic alloy more reliably.

In one embodiment the soft magnetic alloy has a area proportion of a {100}<uvw> texture (also known as cube face texture) of at least 30%, preferably at least 50%, including grains with a tilt of up to +/−15°, or preferably up to +/−10°, when compared to the nominal crystal orientation. The magnetic properties are improved still further with a combination of a area proportion of a {111}<uvw> texture of no more than 13%, preferably no more than 6%, and a area proportion of a {100}<uvw> texture of at least 30%, preferably at least 50%.

In some embodiments the average grain size of the {100}<uvw>-oriented grains is at least 1.5 times, preferably at least 2.0 times, the average grain size of the {111}<uvw>-oriented grains.

In some embodiments the area proportion of the {100}<uvw>-oriented grains is at least 3 times, preferably at least 7 times, the area proportion of the {111}<uvw>-oriented grains.

In some embodiments the soft magnetic alloy has a maximum permeability $\mu_{max} \geq 6{,}000$ and/or an electrical resistance $\rho \geq 0.25$ μΩm, hysteresis losses $P_{Hys} \leq 0.07$ J/kg at an amplitude of 1.5 T and/or a coercive field strength $H_c$ of ≤0.8 A/cm and/or an induction $B_{20} \geq 1.70$ T at 20 A/cm, or a maximum permeability $\mu_{max} \geq 10{,}000$ and/or an electrical resistance $\rho \geq 0.25$ μΩm and/or hysteresis losses $P_{Hys} \leq 0.06$ J/kg at an amplitude of 1.5 T and/or a coercive field strength $H_c$ of ≤0.5 A/cm and an induction $B_{20} \geq 1.74$ T at 20 A/cm.

In some embodiments the composition of the soft magnetic alloy is further defined, wherein:

10 wt %≤Co≤20 wt %, preferably 15 wt %≤Co≤20 wt %, and 0.5 wt %≤V≤4.0 wt %, preferably 1.0 wt %≤V≤3.0 wt %, preferably 1.3 wt %≤V≤2.7 wt %, and/or 0.1 wt %≤Cr≤2.0 wt %, preferably 0.2 wt %≤Cr≤1.0 wt %, preferably 0.3 wt %≤Cr≤0.7 wt %, and/or 0.1 wt %≤Si≤2.0 wt %, preferably 0.15 wt %≤Si≤1.0 wt %, preferably 0.2 wt %≤Si≤0.5 wt %, and/or the chemical formula being 0.1 wt %≤Cr+Si+Al+Mn≤1.5 wt %, preferably 0.2 wt %≤Cr+Si+Al+Mn≤0.6 wt %.

In one embodiment the composition consists essentially of:

| | | | | |
|---|---|---|---|---|
| 5 wt % | ≤ | Co | ≤ | 25 wt % |
| 0.3 wt % | ≤ | V | ≤ | 5.0 wt % |
| 0 wt % | ≤ | Cr | ≤ | 3.0 wt % |
| 0 wt % | ≤ | Si | ≤ | 3.0 wt % |
| 0 wt % | ≤ | Mn | ≤ | 3.0 wt % |
| 0 wt % | ≤ | Al | ≤ | 3.0 wt % |
| 0 wt % | ≤ | Ta | ≤ | 0.5 wt % |
| 0 wt % | ≤ | Ni | ≤ | 0.5 wt % |
| 0 wt % | ≤ | Mo | ≤ | 0.5 wt % |
| 0 wt % | ≤ | Cu | ≤ | 0.2 wt % |
| 0 wt % | ≤ | Nb | ≤ | 0.25 wt % |
| 0 wt % | ≤ | Ti | ≤ | 0.05 wt % |
| 0 wt % | ≤ | Ce | ≤ | 0.05 wt % |
| 0 wt % | ≤ | Ca | ≤ | 0.05 wt % |
| 0 wt % | ≤ | Mg | ≤ | 0.05 wt % |
| 0 wt % | ≤ | C | ≤ | 0.02 wt % |
| 0 wt % | ≤ | Zr | ≤ | 0.1 wt % |
| 0 wt % | ≤ | O | ≤ | 0.025 wt % |
| 0 wt % | ≤ | S | ≤ | 0.015 wt % |

and the rest iron, where Cr+Si+Al+Mn≤3.0 wt % and the composition containing up to 0.2 wt % of other impurities due to melting. Other impurities include, for example, B, P, N, W, Hf, Y, Re, Sc, Be and other lanthanides except Ce.

A laminated core comprising a plurality of stacked electrically insulated laminations of a soft magnetic alloy according to any one of the preceding embodiments is also provided. In some embodiments the laminated core has a fill factor F≥90%, preferably >94%, it being possible to ensure a greater power density.

In some embodiments the laminated core has at least two laminations that each have a thickness of 0.05 mm to 0.50 mm, and the electrical insulation layer, e.g. a ceramic layer or an oxide layer, between adjacent laminations has a thickness of 0.1 μm to 5.0 μm, preferably 0.5 μm to 3.0 μm.

The invention also relates to the use of the laminated core according to any one of the preceding embodiments in an electrical machine, e.g. as a stator tooth or stator segment, or in a stator and/or rotor of an electric motor and/or generator, and/or in a transformer and/or in an electromagnetic actor.

BRIEF DESCRIPTION OF THE DRAWINGS

Embodiments and examples are explained below with reference to the drawings.

DETAILED DESCRIPTION

Figure 1:
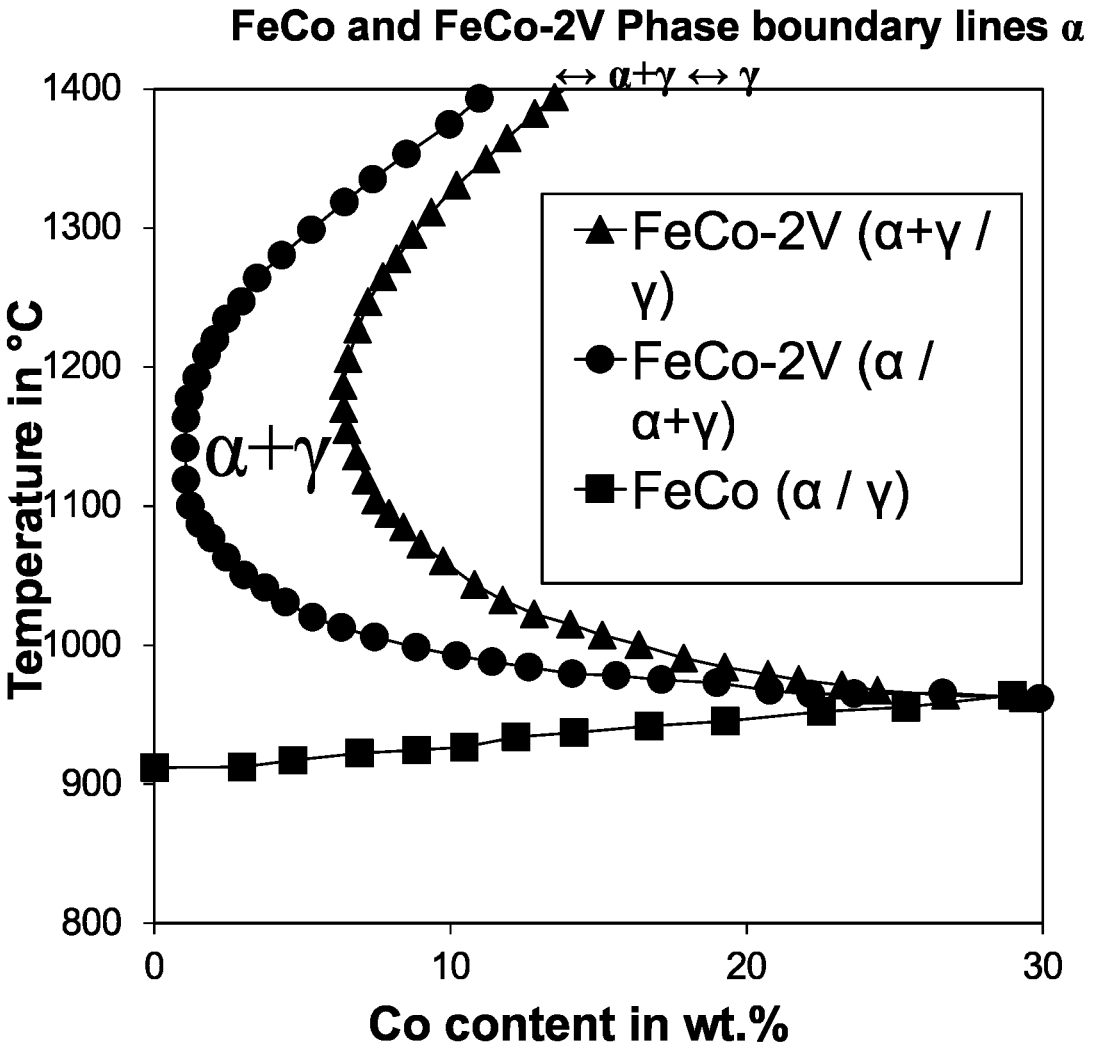
FIG. 1 shows an example phase diagram for one of the alloy variants according to the invention with different Co contents and with 2% V.

FIG. 1 shows a schematic representation of a phase diagrams of an FeCo alloy with the composition of the preliminary product. It indicates the BCC-phase region, also referred to as the ferritic α region, the mixed BCC/FCC region, also referred to as the two-phase α+γ region and the FCC-phase region, also referred to as the austenitic γ region, and illustrates the transition temperatures $T_{\alpha/\alpha+\gamma}$ and $T_{\alpha+\gamma/\gamma}$. The transition temperatures $T_{\alpha/\alpha+\gamma}$ and $T_{\alpha+\gamma/\gamma}$ and the difference $T_{\alpha+\gamma/\gamma}-T_{\alpha/\alpha+\gamma}$ are dependent on the composition of the alloy.

According to the invention the FeCo alloy has a composition that consists essentially of:

| | | | | |
|---|---|---|---|---|
| 2 wt % | ≤ | Co | ≤ | 30 wt % |
| 0.3 wt % | ≤ | V | ≤ | 5.0 wt % |
| 0 wt % | ≤ | Cr | ≤ | 3.0 wt % |
| 0 wt % | ≤ | Si | ≤ | 5.0 wt % |
| 0 wt % | ≤ | Mn | ≤ | 5.0 wt % |
| 0 wt % | ≤ | Al | ≤ | 3.0 wt % |
| 0 wt % | ≤ | Ta | ≤ | 0.5 wt % |
| 0 wt % | ≤ | Ni | ≤ | 1.0 wt % |
| 0 wt % | ≤ | Mo | ≤ | 0.5 wt % |
| 0 wt % | ≤ | Cu | ≤ | 0.2 wt % |
| 0 wt % | ≤ | Nb | ≤ | 0.25 wt % |
| 0 wt % | ≤ | Ti | ≤ | 0.05 wt % |
| 0 wt % | ≤ | Ce | ≤ | 0.05 wt % |
| 0 wt % | ≤ | Ca | ≤ | 0.05 wt % |
| 0 wt % | ≤ | Mg | ≤ | 0.05 wt % |
| 0 wt % | ≤ | C | ≤ | 0.02 wt % |
| 0 wt % | ≤ | Zr | ≤ | 0.1 wt % |
| 0 wt % | ≤ | O | ≤ | 0.025 wt % |
| 0 wt % | ≤ | S | ≤ | 0.015 wt %, |

the rest iron and up to 0.2 wt % of other impurities due to melting.

The alloy has a phase transition from a BCC-phase region to a mixed BCC/FCC-region to a FCC-phase region. As the temperature increases, the phase transition between the BCC-phase region and the mixed BCC/FCC-region takes place at a first transition temperature $T_{\alpha/\alpha+\gamma}$ and, as the temperature continues to increase, the transition between the mixed BCC/FCC-region and the FCC-phase region takes place at a second transition temperature $T_{\alpha+\gamma/\gamma}$, $T_{\alpha+\gamma/\gamma}>T_{\alpha/\alpha+\gamma}$, as is shown in FIG. 1. The composition is chosen such that the difference $T_{\alpha+\gamma/\gamma}-T_{\alpha/\alpha+\gamma}$ is less than 45K, preferably less than 25K.

In order to improve the magnetic properties of the alloy, heat treatment is carried out on a preliminary product of the aforementioned composition. This heat treatment is known as final annealing because it takes place after all the deformation steps such as hot rolling and cold rolling. The preliminary product may take the form of a strip or a sheet or lamination. Following heat treatment no further cold forming is carried out on the alloy. According to the invention this final annealing comprises heat treatment at a temperature at which the alloy is in the FCC-phase region.

Figure 2:
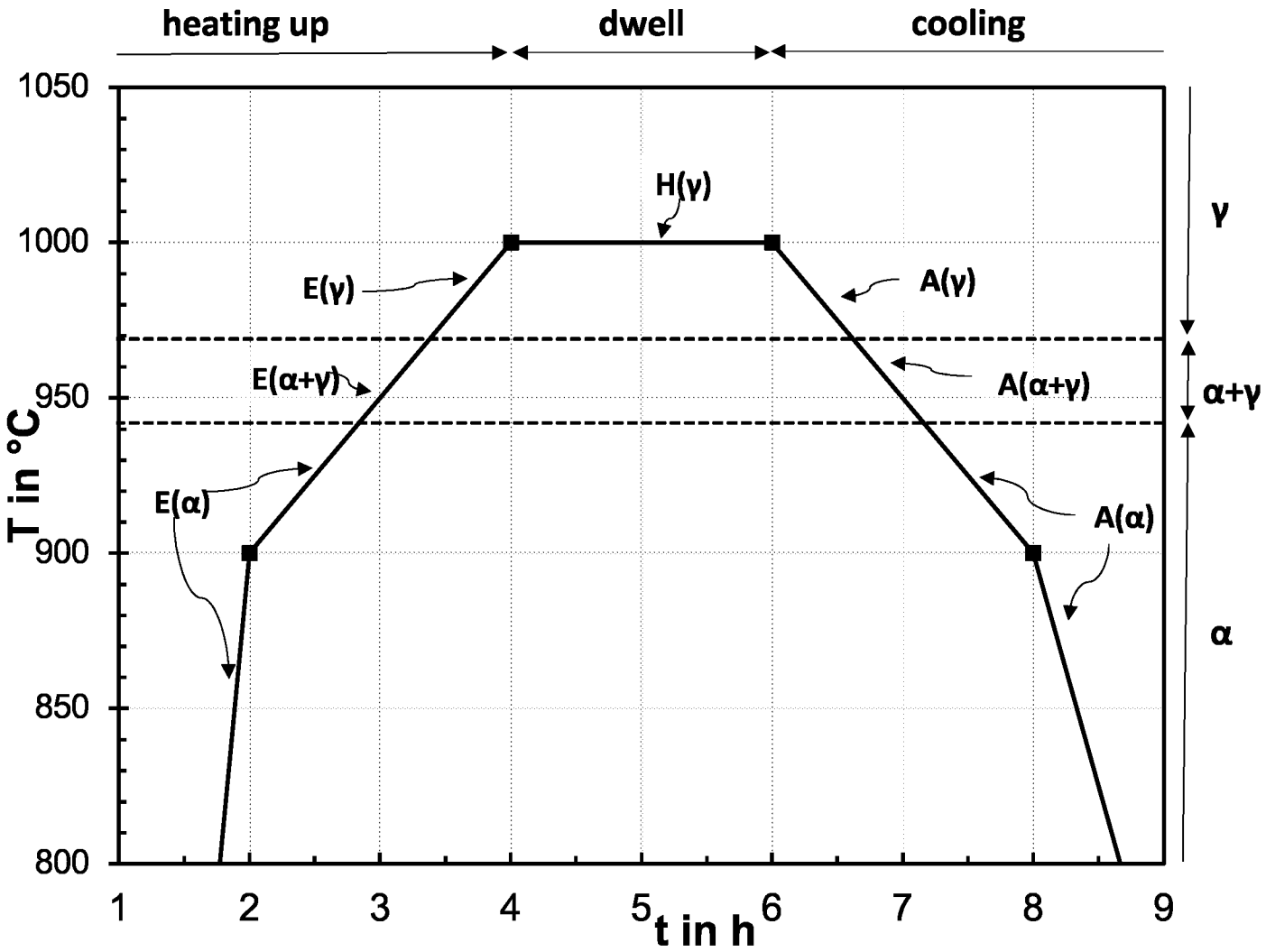
FIG. 2 shows a schematic representation of a sequence of a heat treatment process according to the invention.

FIG. 2 shows a schematic representation of the sequence of heat treatment according to the invention according to an embodiment for an alloy with the aforementioned composition. The alloy may be heat treated in the form of a strip or a sheet or a lamination or a lamination having its end contour. The sequence is divided into three processes: 'heating' (E), 'dwell' (H) and 'cooling' (A). These processes are then subdivided according to the crystallographic phase of the preliminary product. The ferritic region (BCC) is indicated by the letter α, the austenitic region (FCC) by the letter γ and the two-phase mixed region (BCC/FCC) by the letters α+γ.

In the first heating phase E(α) the material is entirely in the ferritic phase. Once it has passed through the T(α→α+γ) phase transition, the material passes through the two-phase mixed α+γ region in the E(α+γ) phase. This relatively narrow region is limited at the top by the T(α+γ→γ) phase transition, where it reaches the heating phase E(γ). The holding phase H(γ) is located entirely in the austenitic γ-region. After cooling A(γ) from the first annealing step in the austenitic γ-region and reaching the T(γ→α+γ) phase transition, cooling A(α+γ) takes place partially in the two-phase α+γ region, which is limited at the bottom by the T(α+γ→α) phase transition. During the remaining cooling period A(α) the material is in the ferritic α-region. According to the invention the maximum temperature of the heat treatment is in the FCC-region.

The temperature ramps during heating and cooling illustrated in FIG. 2 serve to achieve defined heating and cooling of the entire annealing material in a technical process. In principle, the temperatures at which the T(α→α+γ) and T(α+γ→γ) phase transitions take place during heating and at which the T(α+γ→γ) and T(γ→α+γ) phase transitions take place during cooling are identical. In practice, however, shifts in the lower ° C. range may occur due to final heating and cooling speeds, i.e. the temperatures determined during heating may be somewhat higher than the temperatures determined during cooling.

Surprisingly, it has been found that the set-up of the preliminary products during heat treatment, which includes a step above the $T_{\alpha+\gamma/\gamma}$ transition temperature, has an effect on the magnetic properties measured. In order to examine this observation more closely samples with uncovered surfaces in a freely hanging set-up and samples covered with a powder were heat treated in the three phase regions shown schematically in FIG. 1. The results are listed in Table 1, which shows this.

To this end, punched rings measuring 28.5 mm×20.0 mm were produced from a 0.35 mm thick strip of the aforementioned VACOFLUX X1 alloy with a nominal composition of 16.8% Co, 2.3% V, no added Si and the rest Fe. The samples were annealed in a tube furnace with dry hydrogen flushing. Some samples (denoted by the letter H) were heat treated hanging so that all surfaces were in contact with the hydrogen. Some samples (denoted by the letter P) were covered with powder and heat treated in this state.

TABLE 1

| Sample | Annealing ($H_2$) | $T_{max}$ in ° C. | Phase ($T_{max}$) | Set-up |
|---|---|---|---|---|
| H1 | 4 h 910° C. | 910 | a | Hanging |
| H2 | H1 + 4 h 930° C. | 930 | α | Hanging |
| H3 | H2 + 4 h 950° C. | 950 | α | Hanging |
| H4 | H3 + 4 h 970° C. | 970 | α + γ | Hanging |
| H5 | H4 + 4 h 990° C. | 990 | α + γ/γ | Hanging |
| H6 | H5 + 4 h 1010° C. | 1010 | γ | Hanging |
| H7 | H5 + 4 h 1030° C. | 1030 | γ | Hanging |
| H8 | H6 + 4 h 1050° C. 1050 | 1030 | γ | Hanging |
| P1 | 4 h 910° C. | 910 | α | Powder |
| P2 | P1 + 4 h 930° C. | 930 | α | Powder |
| P3 | P2 + 4 h 950° C. | 950 | α | Powder |
| P4 | P3 + 4 h 970° C. | 970 | α + γ | Powder |
| P5 | P4 + 4 h 990° C. | 990 | α + γ/γ | Powder |
| P6 | P5 + 4 h 1010° C. | 1010 | γ | Powder |
| P7 | P6 + 4 h 1030° C. | 1030 | γ | Powder |
| P8 | P7 + 4 h 1050° C. | 1050 | γ | Powder |

Figure 3:
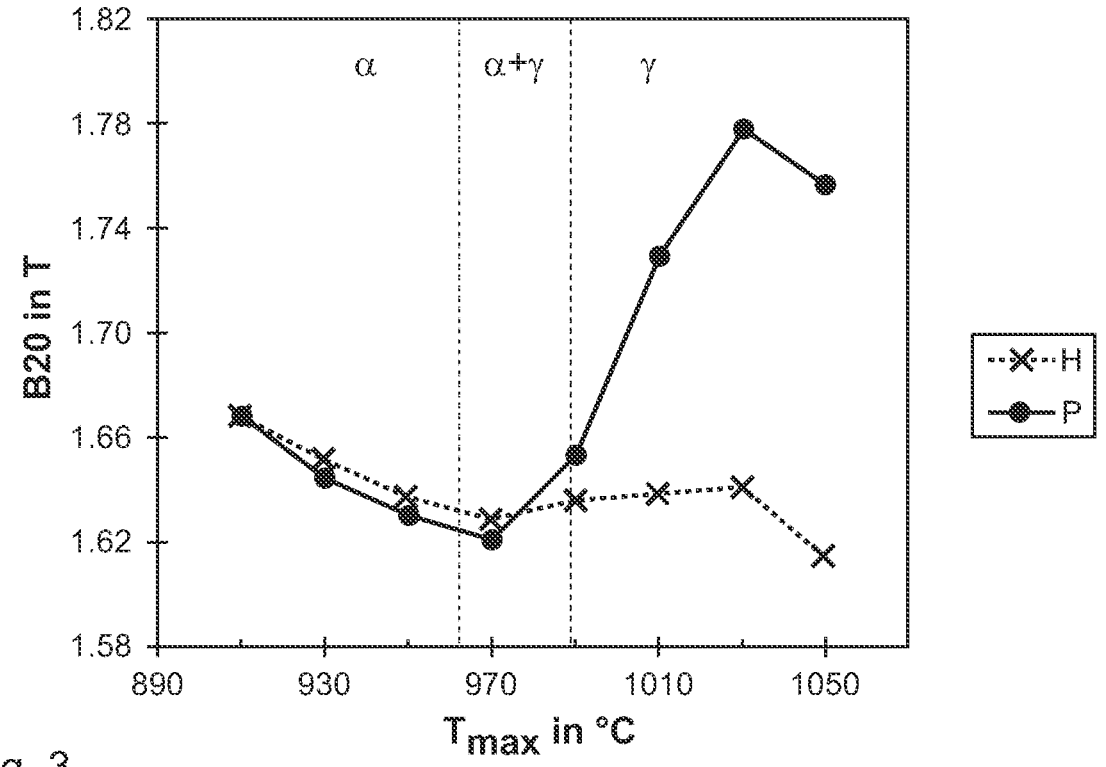
FIG. 3 shows magnetic induction B20, B20 referring to induction at a field strength H of 20 A/cm, for exposed and powder-covered samples.
Figure 4:
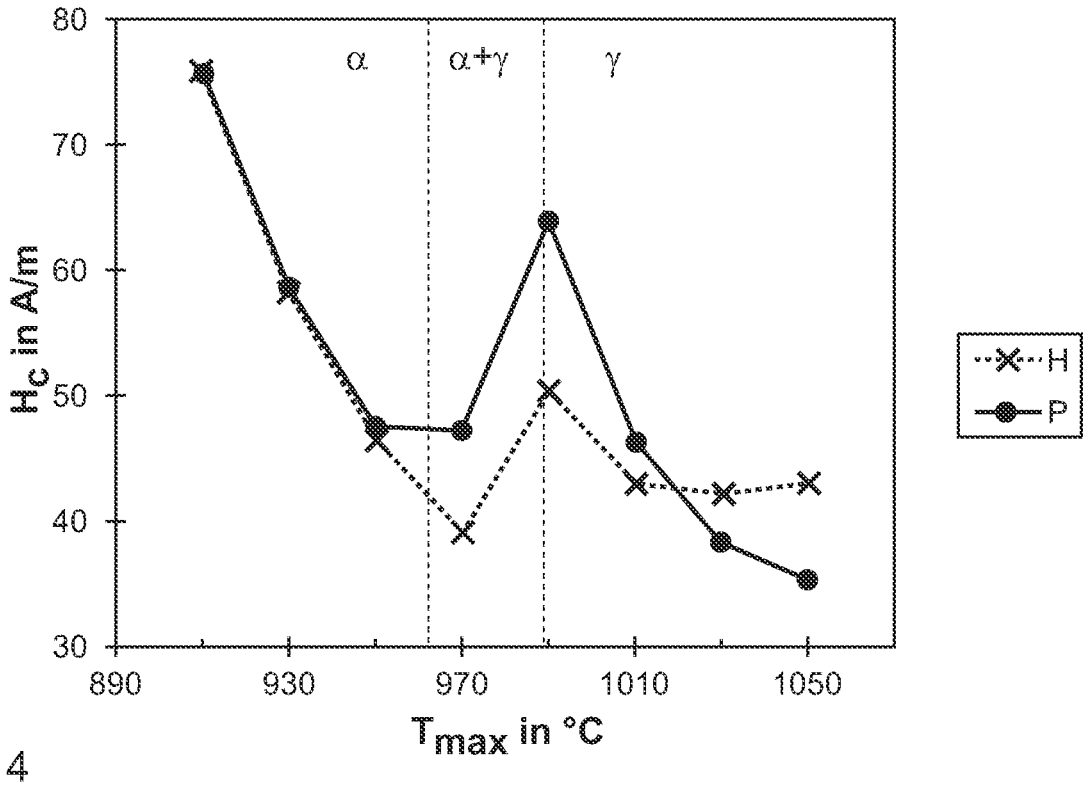
FIG. 4 shows the coercive field strength $H_c$ for exposed and powder-covered samples.

FIG. 3 shows the magnetic induction B20, where B20 refers to induction at 20 A/cm, and FIG. 4 shows the coercive field strength Hc measured for these samples. After annealing in the γ-region, e.g. at 1010° C., the rings in the H series that were annealed hanging freely without powder and with very good hydrogen flushing show B20 induction values similar to the samples annealed in the α-region. Indeed, coercive field strength is in the region of the best annealing in the α-region. It was thus possible to completely avoid any deterioration in soft magnetic parameters due to the narrow two-phase region despite phase transformation during heating and cooling for the samples annealed in the γ-region.

In contrast, the rings in series P that were annealed in powder densely packed show a completely different behaviour. Annealing in the γ-region (1010° C.) results in clearly increased B20 induction values that are more than 100 mT above the best value obtained after annealing in the α-region. As temperature progresses, coercive field strength $H_c$ continues to drop. After annealing at 1050° C. it actually falls below the best Hc values obtained after annealing in the α-region.

Texture was examined by means of EBSD (Electron Backscatter Diffraction). Four states with the composition 17.25% Co, 1.49% V, 0.23%, Si and the rest Fe were examined, cf. Table 2. Sample A, a reference sample, was not annealed. Sample B, a reference sample, was annealed at 930° C. in the α-region. Sample C was annealed according to the invention in the γ-region at 1000° C., with the sample rings lying in ceramic annealing powder. Sample D, a reference sample, was annealed as for sample C but free hanging without powder.

TABLE 2

| Sample | T in ° C. | T in h | Atmosphere | Set-up |
|---|---|---|---|---|
| A | — | — | — | — |
| B | 930 | 4 | H2 | Powder |
| C | 1000 | 4 | H2 | Powder |
| D | 1000 | 4 | H2 | No powder, free hanging |

In addition to the magnetic samples (28.5 mm×20.0 mm punched rings), two strips measuring 50 mm×32 mm were also made from each sample. They were also annealed in powder or exposed and subjected to EBSD texture determination. The texture of the sheets that were annealed exposed was determined on the upper surface that was exposed during annealing.

Figure 5:
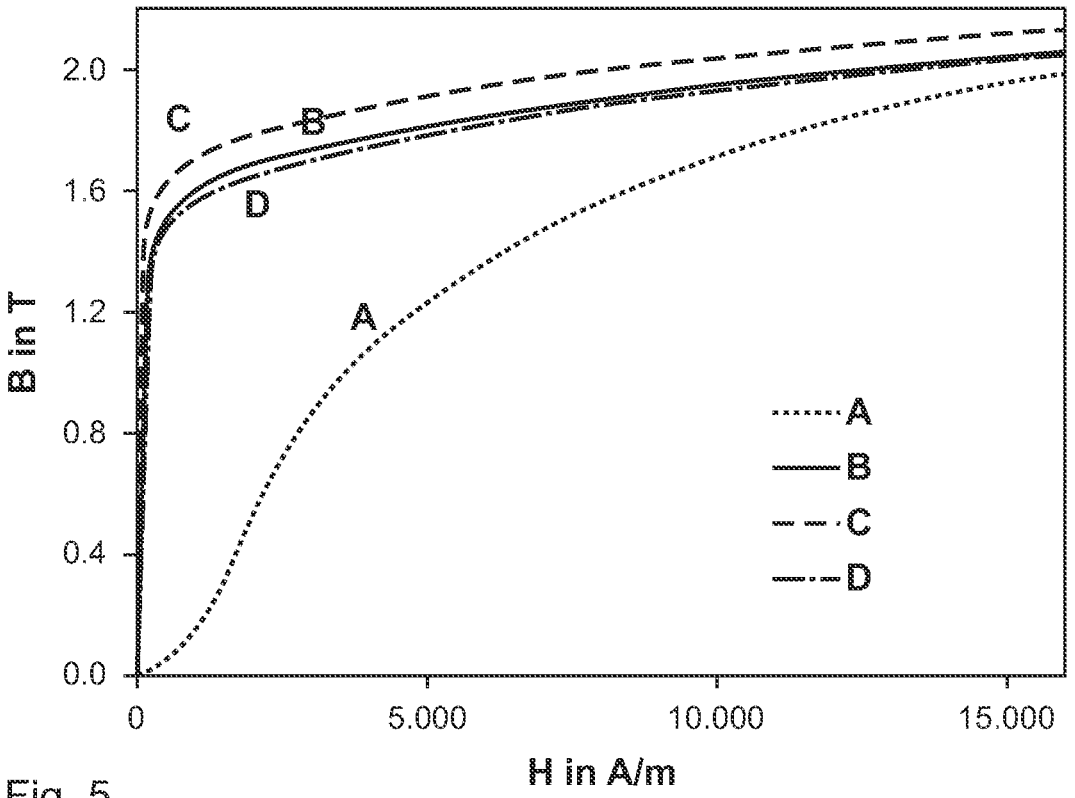
FIG. 5 shows an initial magnetization curve B(H) for exposed and powder-covered samples.
Figure 6:
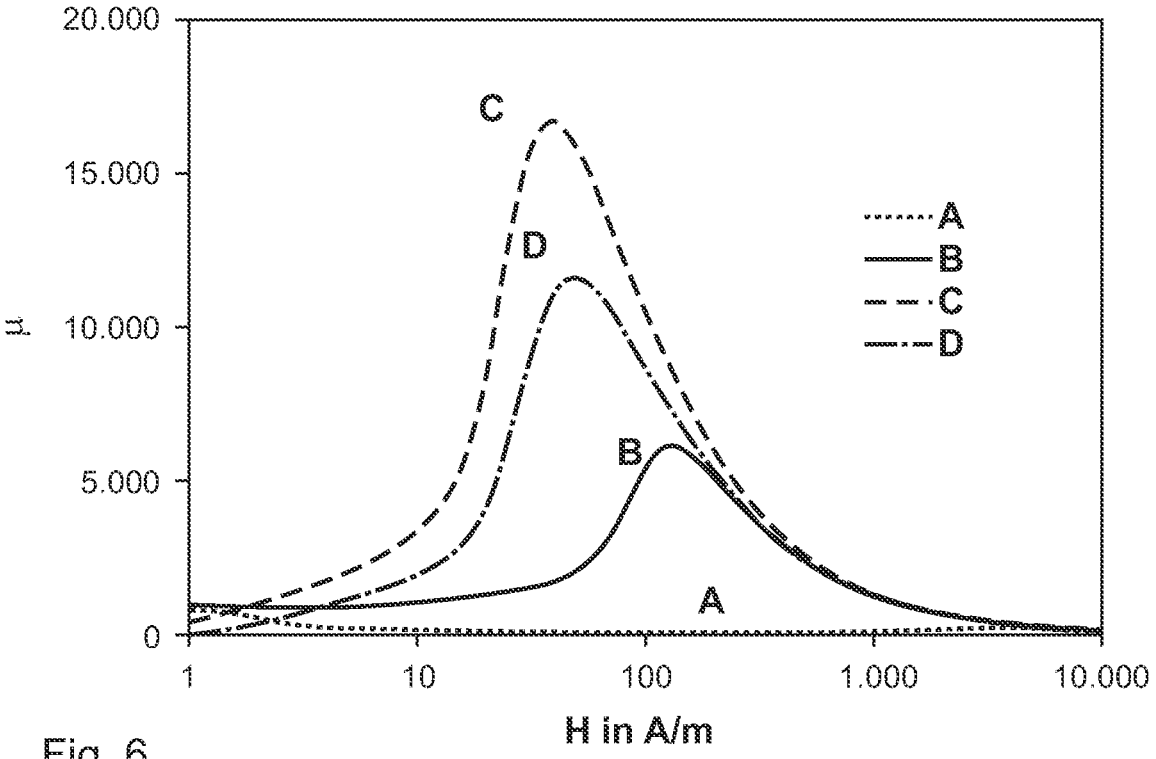
FIG. 6 shows the curve of permeability μ(H) for exposed and powder-covered samples.

The magnetic properties measured were the initial magnetization curve B(H) or μ(H), coercive field strength $H_c$ and remanence $B_r$. The area proportions A(001) and A(111) of grains with (001) or (111) orientation were determined at a maximum tilt of +/−10° from the ESBD measurements. In addition, the area proportion A'(001) was also determined for samples B, C and D with a maximum tilt of +/−15°. Average grain size GS was also determined from the EBSD measurements. Table 3 shows the magnetic parameters, the texture area proportions and the average grain size GS. In sample A no texture fractions were initially determined. The A'(001) parameter alone was determined subsequently. FIG. 5 and FIG. 6 also show the initial magnetization curve B(H) and the curve of permeability μ(H).

TABLE 3

| Sample | B20 in T | Br in T | A(001) in % | A'(001) in % | A(111) in % | GS in μm |
|---|---|---|---|---|---|---|
| A | 0.528 | 0.70 | — | 22.9 | — | — |
| B | 1.682 | 1.16 | 21.7 | 30.8 | 29.5 | 161 |
| C | 1.783 | 1.41 | 51.9 | 69.2 | 4.3 | 917 |
| D | 1.643 | 1.31 | 27.9 | 38.1 | 13.6 | 459 |

As is to be expected with a highly cold worked material, the unannealed sample A shows very low inductions and a very high $H_c$>1500 A/m.

Sample B, annealed in the α-region, shows clearly improved properties, though with a B(20 A/cm) of 1.682 T it is still below the target value of at least 1.70 T. It can be assumed that there is no or little texture here since the A(001) and A(111) area proportions of grains of different orientation are similar in size.

Sample C, annealed in powder in the γ-region, shows the best magnetic properties. Induction B(20 A/cm) is extremely high at 1.783 T. The A(001) area proportion is higher, the A(111) area proportion lower. In addition, the very low coercive field strength of 31 A/m and the high permeability indicate large grain diameters.

Sample D, annealed without powder in the γ-region, on the other hand, shows clearly lower induction B(20 A/cm) <1.65 T similar to that of sample B. This is in contrast to $H_c$, which is lower, and $\mu_{max}$, which is higher, probably due to the increase in grain growth caused by the higher annealing temperature and the associated higher diffusion speed in the γ-region. The A(001) area proportion is smaller and the A(111) area proportion larger than for sample C. It was therefore found that the differences in magnetic properties between the two sets of tests could be ascribed to the different annealing textures.

Figure 7:
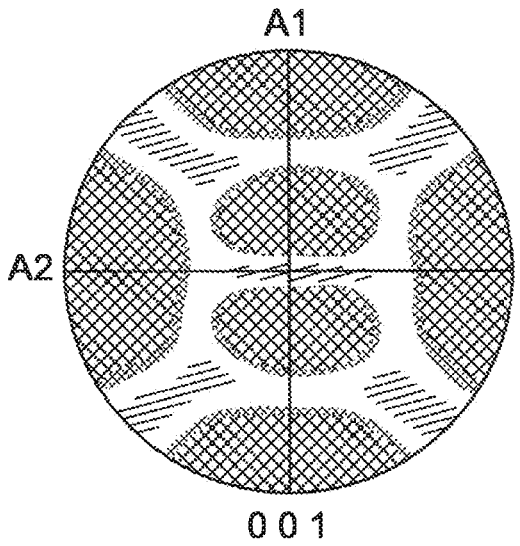
FIG. 7 shows (001) pole figures for exposed and powder-covered samples.
Figure 7:
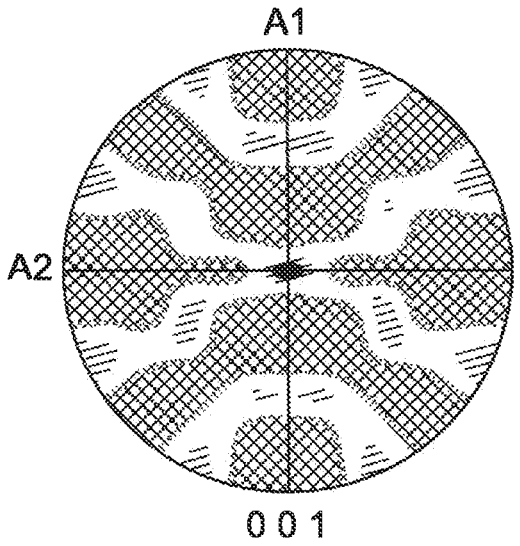
Figure 7:
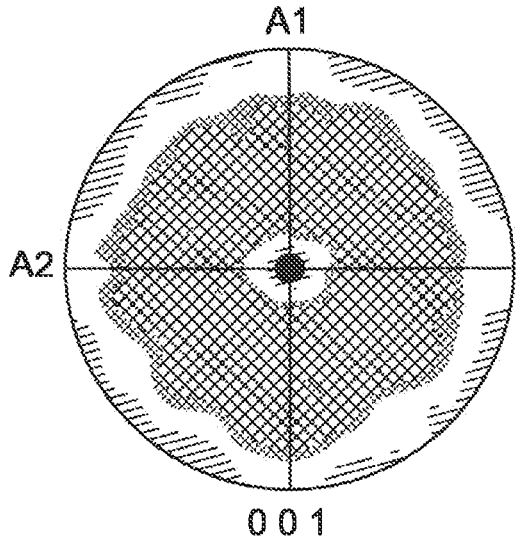
Figure 7:
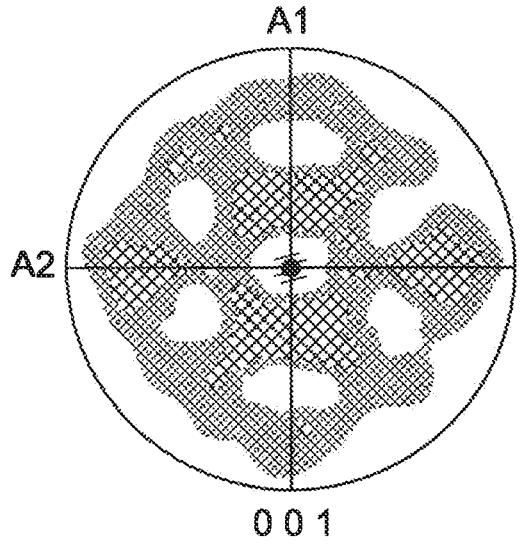

FIG. 7 shows the 001 pole figures by way of example as they illustrate the essential symmetries. The other pole figures 110 and 111 can be found in the appendix. A1 indicates the rolling direction (RD) and A2 the transverse direction (TD). (Axis A1||rolling direction).

The rolling texture (sample A) changes as a result of annealing in the α-region (sample B) into an annealing texture that contains both (001) fractions (intensities in the middle and at the outer edge) and (111) fractions (intensities along half the diameter). The pole figure after annealing in the γ-region (sample C) looks quite different. It clearly corresponds to a cube face texture (001). Following annealing without powder in the γ-region (sample D) there are not only fractions with (001) and (111) orientations, but also a diffused plurality of other orientations in the typical annealing and rolling texture ranges of BCC materials.

Figure 8:
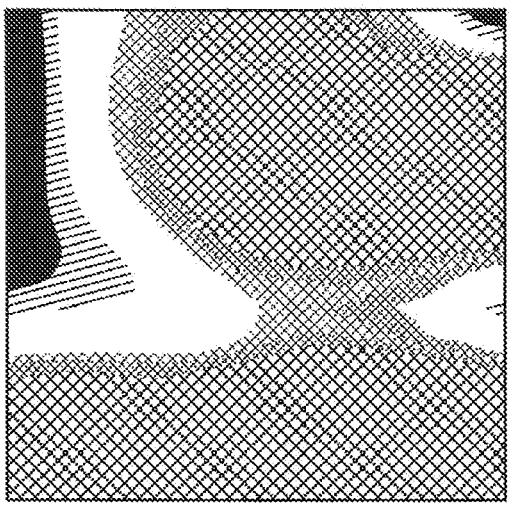
FIG. 8 shows orientation density distribution functions (ODF) for exposed and powder-covered samples.
Figure 8:
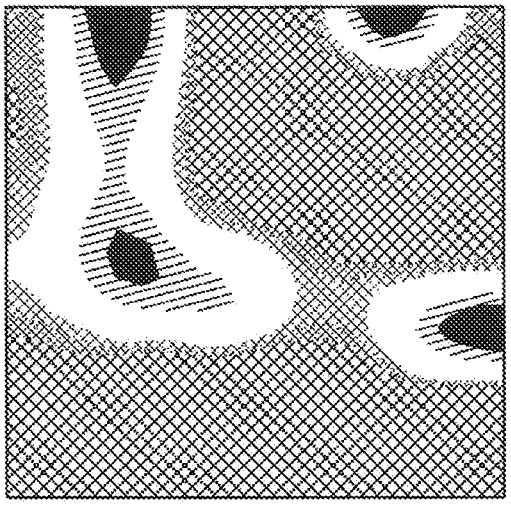
Figure 8:
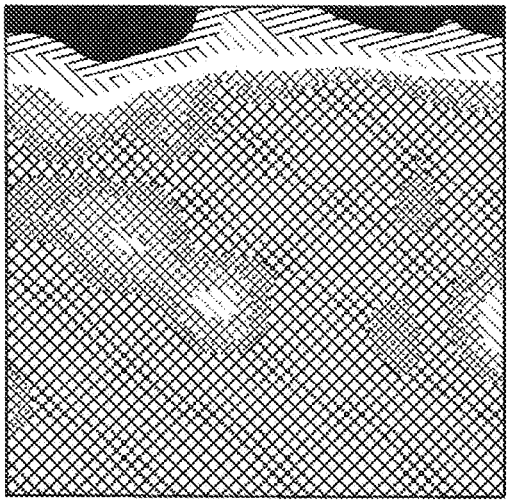
Figure 8:
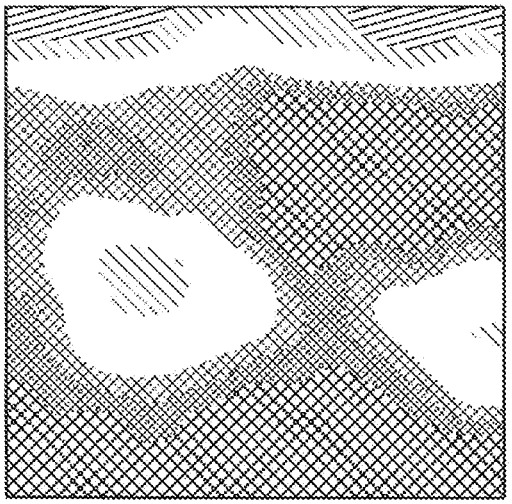

FIG. 8 shows the ODF (orientation density distribution function) at φ2=45° for samples A to D.

Sample A (reference, as rolled) has all fractions of the α fibre, i.e. from {001}<110> via {112}<110> to {111}<110>. This is typical of a cold rolling texture of bcc metals. In addition, fractions of the γ fibre are also identifiable, i.e. {111}<121> and {111}<112>.

In sample B (reference, annealing in the α-region) this a fibre is shifted by 20° in the angle φ1, corresponding to a rotation of the cubic layer in the sheet plane. The γ-fibre fractions that can be seen in the unannealed state are then intensified. In these orientations the magnetically hard axis, the space diagonal <111>, is in the sheet plane.

Sample C according to the invention shows all fractions of the θ fibre, i.e. from {001}<110> via {001}<010> to {001}<110>. This corresponds to a magnetically advantageous cube face texture in which the magnetically soft axis, the cube edge <001>, is in the sheet plane, and the orientation of these cube edges varies between the rolling direction and the direction across the rolling direction. Furthermore, there are hardly any fractions of the magnetically unfavourable γ fibre. Annealing was able to bring about a significant reduction in these magnetically unfavourable fractions.

Reference sample D, which was also annealed in the γ-region but with a different annealing set-up, also has cubic layers. In contrast to sample C, however, they are significantly less marked and are also more strongly oriented. In addition, there are clearly higher fractions of the magnetically unfavourable γ fibre, i.e. {111}<121> and {111}<112> fractions, compared to sample C.

These texture investigations show that the cause of the high B20 induction values of state C according to the invention lies firstly in the formation of a cube face texture, i.e. the formation of orientations of the α fibre and, secondly, in the avoidance of fractions of the γ fibre.

In order to further examine the dependence of the magnetic parameters on texture, a series of samples of the VACOFLUX X1 alloy from the same batch (7410163B) was annealed at different temperatures, for different dwell times and in different atmospheres and set-ups. The parameters are shown in Table 4.

TABLE 4

| State | T in ° C. | Phase (T) | t in h | Atmosphere | Set up | Observations |
|---|---|---|---|---|---|---|
| A1 | 750 | α | 2 | $H_2$ | Powder | — |
| A2 | 930 | α | 4 | $H_2$ | Powder | — |
| A3 | 955 | α + γ | 4 | $H_2$ | Powder | — |
| B1 | 1000 | γ | 4 | $H_2$ | Hanging | — |
| B2 | 1000 | γ | 4 | Vacuum | Stack | — |
| B3 | 1000 | γ | 4 | $H_2$ | Stack | Coated on both sides with HITCOAT |
| C1 | 970 | γ | 2 | $H_2$ | Powder | — |
| C2 | 970 | γ | 2 | $H_2$ | Powder | Pre-annealed 2 h 750° C., $H_2$ |
| C3 | 970 | γ | 4 | $H_2$ | Powder | — |
| C4 | 1000 | γ | 0.5 | $H_2$ | Powder | — |
| C5 | 1000 | γ | 2 | $H_2$ | Powder | — |
| C6 | 1000 | γ | 4 | $H_2$ | Powder | — |
| C7 | 1000 | γ | 20 | $H_2$ | Powder | — |
| C8 | 1100 | γ | 4 | $H_2$ | Powder | — |
| C9 | 1000 | γ | 4 | $H_2$ | Stack | Annealed with coated intermediate layers |
| C10 | 1000 | γ | 4 | $H_2$ | Stack | Coated on one side with HITCOAT |

Table 4 shows a list of the annealing processes carried out giving the parameters and information on the sample. All samples were manufactured from the same batch (74101563B) with a strip thickness of 0.20 mm.

The samples are divided into three series according to annealing temperature T:

A: Annealing in the α-region or in the mixed α+γ region (reference)

B: Annealing in the γ-region with unfavourable parameters (reference)

C: Annealing in the γ-region with favourable parameters (according to the invention)

Here, phase allocation is based on the α→α+γ at 944° C. and α+γ→γ at 965° C. phase transitions determined for this batch. They were determined from a DSC measurement using the $1^{st}$ onset during cooling or heating.

The annealing time, i.e. the dwell time t at annealing temperature, was varied between 0.5 h and 20 h, most annealing processed being carried out with a dwell time of 4 h. The atmosphere used was predominantly dry hydrogen $H_2$ with an initial saturation point of −40° C. or less. In one case, example B2, annealing was carried out in a vacuum at a pressure of 10-1 mbar.

The annealing set-up was also varied. Annealing 'in powder' took place in $Al_2O_3$ ceramic powder. In the 'hanging' set-up, annealing samples were threaded on a ceramic tube a short distance apart. For 'stacked' annealing, the samples (rings or sheets) were placed one on top of another. This stack of sheets was laid on a base plate and weighted down with a covering plate. In order to avoid touching uncoated sample rings from fusing together, rings coated on both sides with HITCOAT were used as intermediate layers, as in example C9. The intermediate layers, which served only as annealing aids, were removed before the magnetic measurements were carried out in order to ensure that the magnetic values related to the uncoated rings.

The tests were evaluated by measuring the magnetic properties and the texture. See Table 6, where B20=B(20 A/cm), B100=B(100 A/cm), A(001)=area proportion (001), A(111)=area proportion (111), GS=average grain size of all orientations, GS(001)=average grain size of the (001) orientation, GS(111)=average grain size of the (111) orientation.

TABLE 5

| State | B20 in T | $B_r$ in T | $H_c$ in A/m | A(001) in % | A(111) in % | GS in μm | GS(001) in μm | GS(111) in μm |
|---|---|---|---|---|---|---|---|---|
| A1 | 1.715 | 1.22 | 166 | 14.8 | 31.2 | 20 | 19.1 | 19.6 |
| A2 | 1.682 | 1.16 | 58.5 | 21.7 | 29.5 | 161 | 139 | 176 |
| A3 | 1.680 | 1.31 | 61.6 | 20.0 | 27.9 | 186 | 161 | 195 |
| B1 | 1.643 | 1.31 | 39.3 | 27.9 | 13.6 | 459 | 373 | 505 |
| B2 | 1.679 | 1.25 | 43.0 | 21.7 | 13.1 | 417 | 452 | — |
| B3 | 1.687 | 1.36 | 46.4 | 15.7 | 14.4 | 455 | 346 | 475 |
| Cl | 1.794 | 1.38 | 34.6 | 65.6 | 1.7 | 502 | 511 | 135 |
| C2 | 1.786 | 1.35 | 36.2 | 61.9 | 3.9 | 391 | 401 | 238 |
| C3 | 1.802 | 1.41 | 30.5 | 60.8 | 1.8 | 728 | 305 | 762 |
| C4 | 1.786 | 1.43 | 34.3 | 59.7 | 3.7 | 526 | 327 | 554 |
| C5 | 1.784 | 1.41 | 30.9 | 61.3 | 3.2 | 789 | 459 | 824 |
| C6 | 1.752 | 1.34 | 30.2 | 38.0 | 5.9 | 1238 | 764 | 1390 |
| C7 | 1.710 | 1.32 | 31.1 | 16.9 | 10 | 1619 | 1021 | 1284 |
| C8 | 1.711 | 1.31 | 30.3 | 10.0 | 12 | 2030 | 929 | 1226 |
| C9 | 1.745 | 1.39 | 33.4 | 48.2 | 5.2 | 409 | 300 | 432 |
| C10 | 1.720 | 1.36 | 40.4 | 25.2 | 9.6 | 451 | 361 | 472 |

Stamped rings measuring 28.5 mm×20.0 mm were annealed for the magnetic measurements. After annealing, the rings were wound with secondary and primary windings in a plastic trough and measured statically in accordance with IEC 60404-4. The values determined are maximum permeability $\mu_{max}$, magnetic inductions B20=B(20 A/cm) and 1B100=B(100 A/cm), remanence $B_r$ and coercive field strength $H_c$.

Sheets measuring 20 mm×30 mm were annealed in the same manner for texture determination. After annealing the sheets were measured using EBSD as described above. The parameters determined are the area proportions A(001) and A(111) of orientations (001) and (111).

Figure 9:
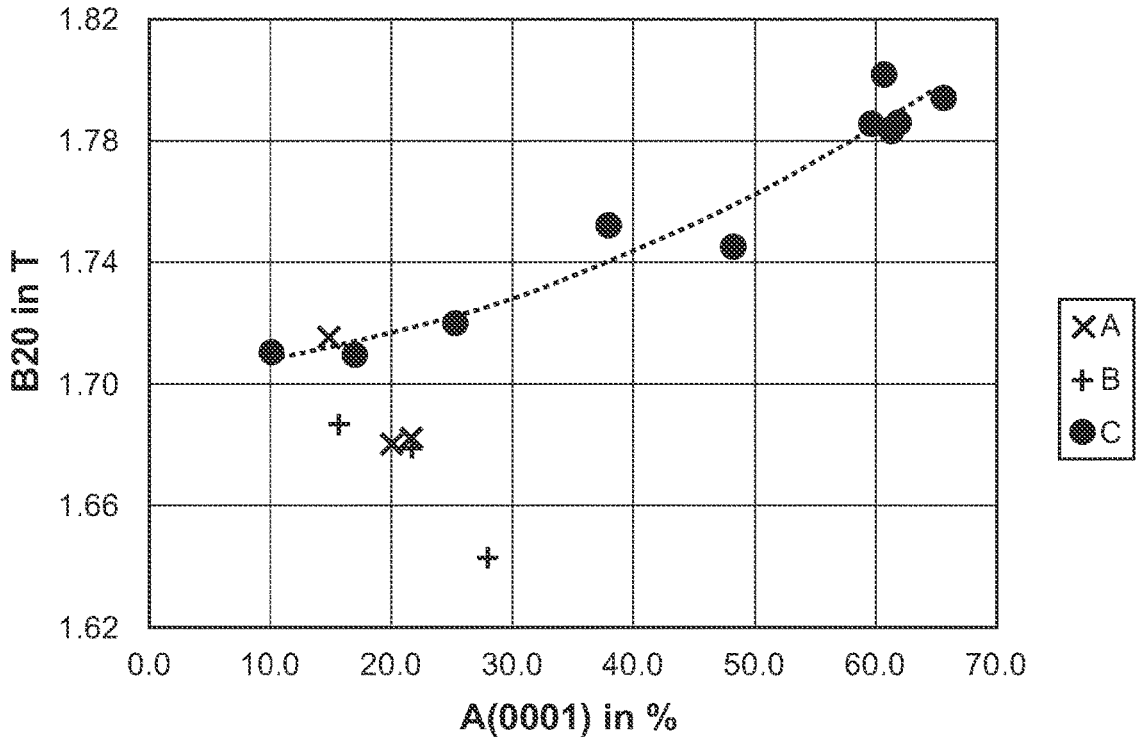
FIG. 9 shows the correlation between magnetic induction B(20 A/cm) and area proportion A(001).

FIG. 9 shows the correlation between magnetic induction B(20 A/cm) and the area proportion A(001) of the magnetically favourable (001) orientation. The dotted line illustrates the curve for series C according to the invention. The reference samples in series A and B show a area proportion of no more than 27.9%. In the samples in series C according to the invention, on the other hand, area proportions A(001) of up to 65.6% are reached. In addition, it can be seen that a higher fraction of cube face texture also leads to higher magnetic induction B(20 A/cm).

The area proportions were determined at a maximum tilt of +/−10°. Were a greater tilt of +/−15° to be tolerated, a area proportion A(001) of up to 82% would result.

Figure 10:
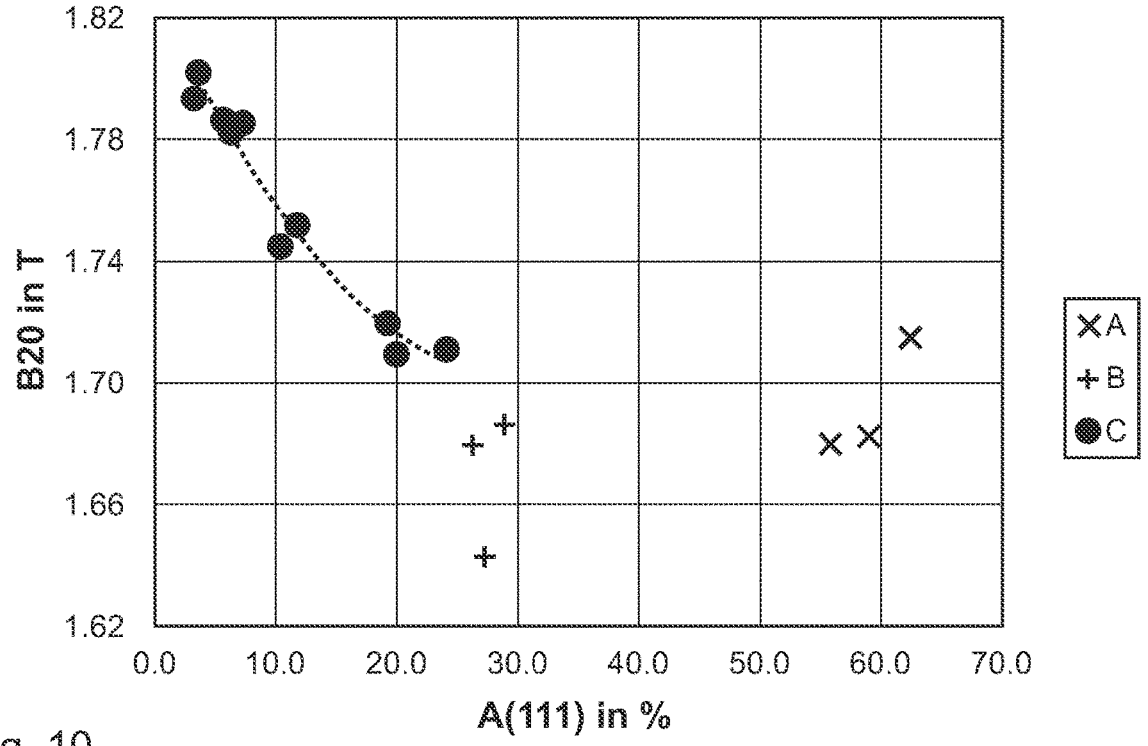
FIG. 10 shows the correlation between magnetic induction B(20 A/cm) and area proportion A(111).

FIG. 10 shows the correlation between magnetic induction B(20 A/cm) and the area proportion A(111) of the magnetically unfavourable (111) orientation. The reference samples in series A and B show area proportions A(111) of at least 13%, associated with a lower induction B20 of less than 1.70 T. Only state A1, which was annealed at the very low temperature of 750° C., shows induction B20 of 1.715 T. As the grain size in this sample is extremely low, there is simultaneously a very high coercive field strength Hc of 166 A/m.

In contrast, the series C states according to the invention show inductions of greater than 1.70 T throughout. The reason for this lies in the small fraction of the magnetically unfavourable (111) orientation. The samples with the smallest A(111) area proportions show the highest induction values B20. The dotted line illustrates the curve for series C according to the invention.

Figure 11:
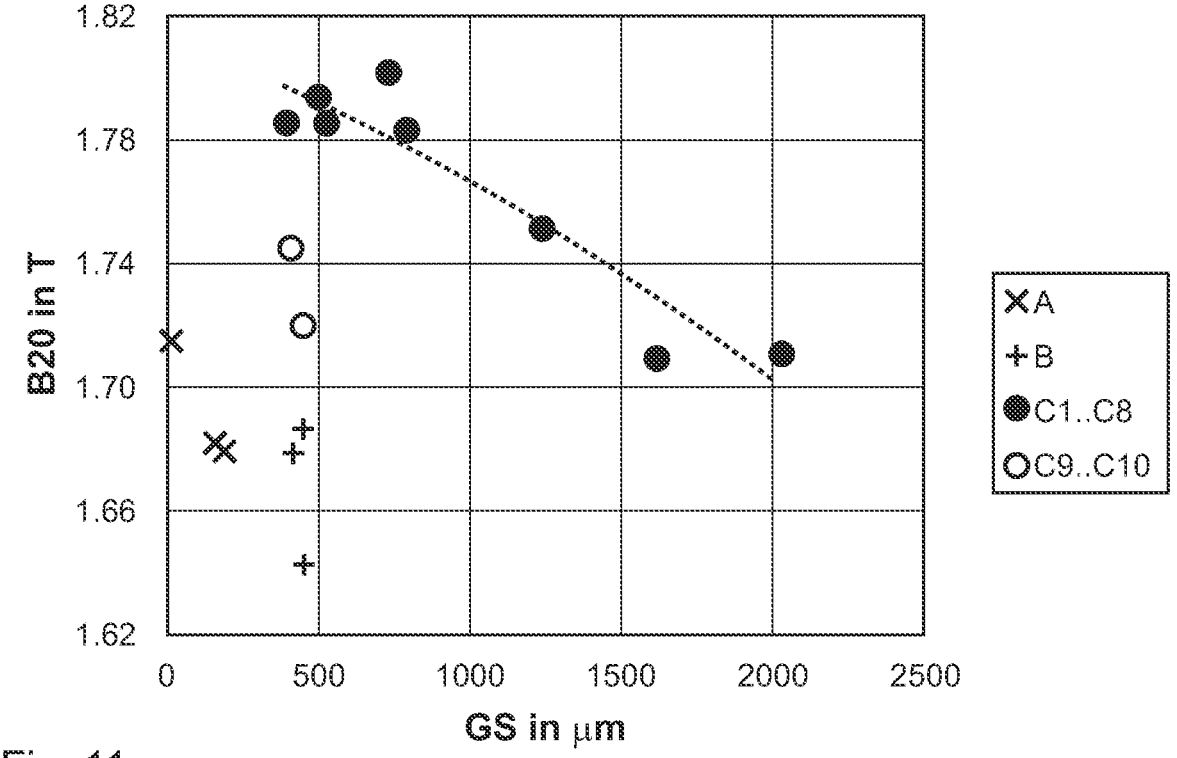
FIG. 11 shows the correlation between magnetic induction B20 and the average grain size GS of all grains.

FIG. 11 shows the correlation between magnetic induction B20 and the average grain size GS of all grains irrespective of their orientation. The samples in series A that were annealed in the ferritic α-region only achieve grain sizes of up to 200 μm. The samples in series B that were annealed in the austenitic γ-region, on the other hand, show clearly larger grains in a range of 400 to 500 μm. Despite this, the desired high level of induction B20 is not achieved. The large grain size alone is not therefore the cause of the high induction B20.

Only the series C samples annealed in favourable conditions in the γ-region show induction values B20>1.70 T. Sample C1, for example, has a grain size of 502 μm, i.e. approx. 0.5 mm, which is similar to the series B values, but in contrast has a very high induction value B20 of 1.794 T.

Furthermore, it has been established that an increase in grain size within series C has a negative influence on induction B20. The values that influence grain size directly are above all annealing temperature and annealing time. Sample C8, for example, has an average grain size of 2030 μm, i.e. approx. 2 mm, due to an increased annealing temperature of 1100° C. This reduces induction B20 to 1.711 T. Sample C7, which was heat treated at 1000° C. but for an extended annealing time of 20 h, also has coarse grains with an average grain size of 1619 μm, i.e. approx. 1.6 mm, and a low induction B20 of only 1.71 T.

States C9 and C10 according to the invention are shown separately in the drawings because the change in annealing set-up results in a deviation. These samples were annealed 'in stacks', i.e. the sheets were placed one on top of another and weighted down with a covering plate. The inductions B20 achieved are still very good, i.e. greater than 1.70 T. In comparison to states C1 to C8, which were annealed in ceramic annealing powder, however, smaller inductions are found at the same grain size. With this set-up, therefore, the annealing parameters must be modified in order to achieve optimum conditions.

Figure 12:
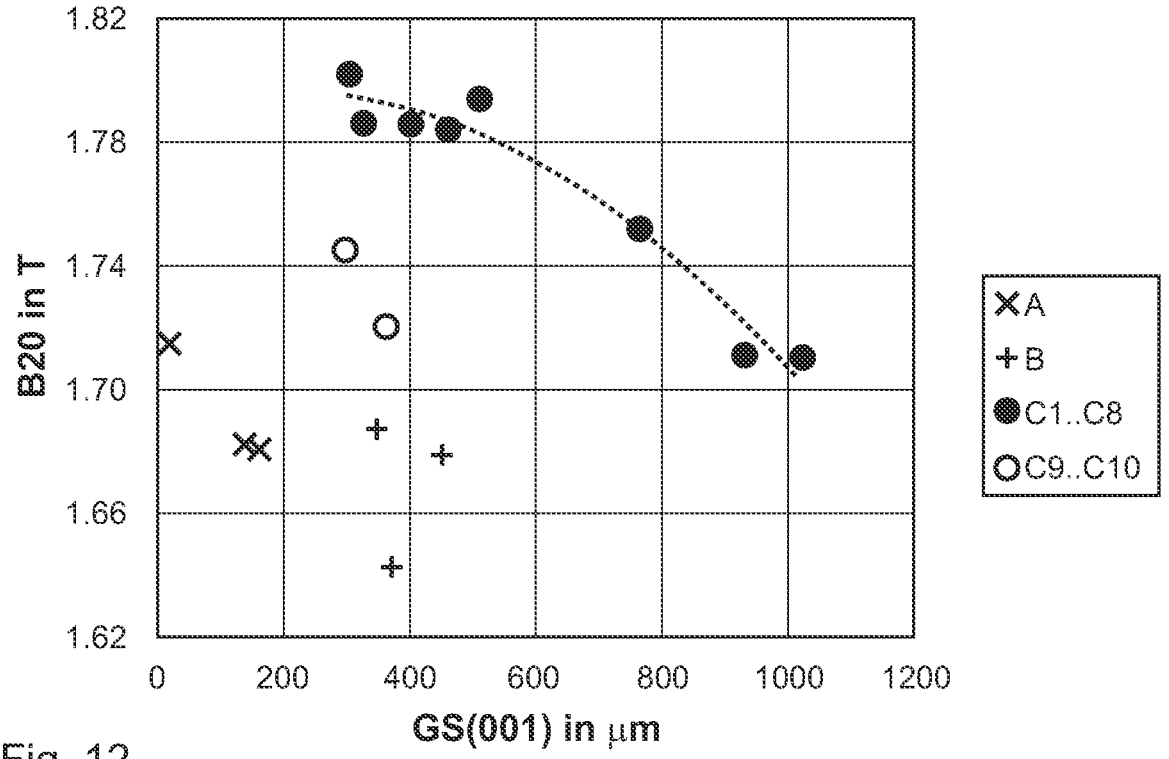
FIG. 12 shows the correlation between induction B20=B (20 A/cm) and the average grain size GS(001) of all grains with (001) orientation.
Figure 13:
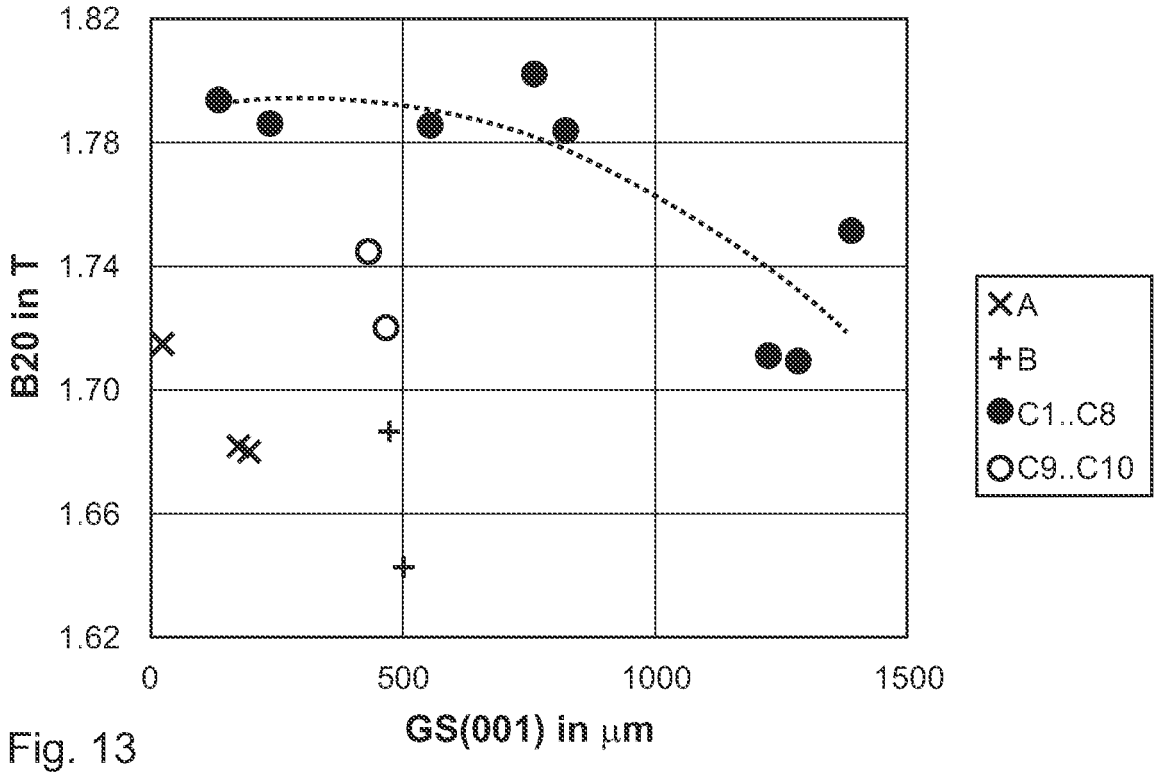
FIG. 13 shows the correlation between induction B20=B (20 A/cm) and the average grain size GS(111) of all grains with (111) orientation.

The results on grain size can also be examined separately according to grain orientation, cf. FIG. 12 for the magnetically favourable (001) orientation and FIG. 13 for the magnetically unfavourable (111) orientation. The interpretation is analogous to the interpretation of total grain size. FIG. 12 shows the correlation between induction B20=B(20 A/cm) and average grain size GS(001) of all grains with (001) orientation. The dotted line illustrates the curve for states C1 to C8 in the series according to the invention. FIG. 13 shows the correlation between induction B20=B(20 A/cm) and average grain size GS(111) of all grains with (111) orientation. The dotted line illustrates the curve for states C1 to C8 in series C according to the invention.

In summary, in order to set the highest possible induction it is desirable to carry out annealing in the γ-region whilst keeping grain size minimal. Possible ways of achieving this include decreasing the annealing temperature so that it is as close as possible to the α+γ→γ phase transition while remaining above it, or by reducing the annealing time. When setting the annealing time it is important to note that the heating and cooling ramps have an indirect influence on annealing time, i.e. slow heating or cooling ramps lead to longer dwell times in the γ-region. Annealing set-up also has a decisive influence.

It is also useful to avoid excessive grain growth in order to ensure the most even magnetisation possible in all directions when a cube face texture is present.

Figure 14:
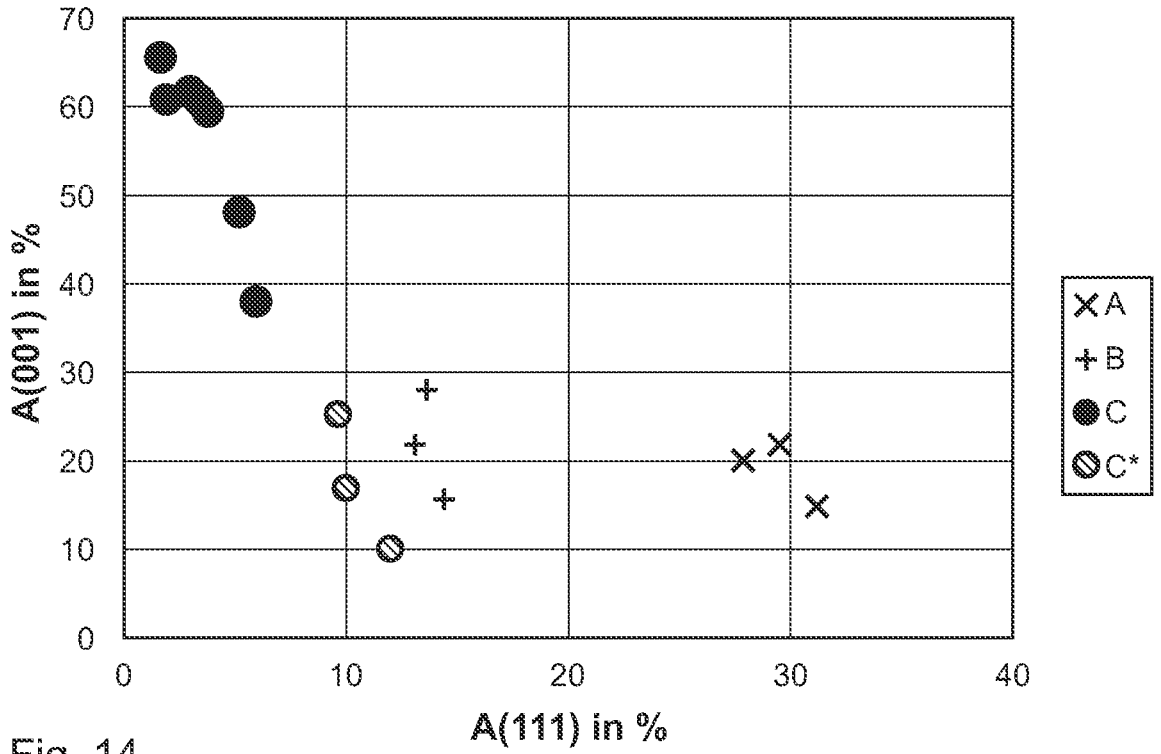
FIG. 14 shows area proportions A(001) and A(111).

Finally, there is also a direct correlation between the formation of the preferred cubic layer (001) and the magnetically unfavourable space diagonals (111). FIG. 14 shows area proportions A(001) and A(111) plotted against one another. The A states annealed in the α-region show a very high fraction of (111) of over 25% and simultaneously a low fraction of (001) of under 25%. Both are unfavourable from a magnetic point of view. The B states annealed in unfavourable conditions in the γ-region show a lower fraction of (111), albeit still relatively high at over 13%. This also explains the low magnetic induction of these states, i.e. B20<1.7 T.

FIG. 14 shows the correlation between the A(001) and A(111) area proportions. The C states according to the invention, which were annealed in favourable conditions in the γ-region, show a area proportion (111) that is below 13% throughout. Here, again, the graph makes a distinction. The points denoted C* (open symbols) correspond to examples C7, C8 and C10. They are borderline in terms of the parameters, i.e. C7 was annealed for an extremely long dwell time of 20 h and C8 was annealed at a very high annealing temperature of 1100° C. In both cases this results in strong growth of the unfavourable (111) orientation. Sample C10 was provided with a continuous annealing-resistant ceramic coating on one side. As a result, during cooling and while passing through the α+γ→α phase transition the favourable (001) texture was therefore able to form on the uncoated side only. Accordingly, in all three samples the (111) fraction remains between 9.6 and 12%.

Furthermore, the (001) fraction is not yet marked and remains relatively low at 10.0 to 25.2%. The C* examples show a B20 value of between 1.70 T and 1.72 T which, though not optimal, is still clearly better than states A and B, which are not according to the invention.

The points marked C (solid symbols) correspond to the remaining examples in group C. They are highly optimised in terms of annealing, i.e. the annealing temperature was above the α+γ→γ phase transition, though not more than 100° C. above this temperature, and the maximum dwell time was 4 h. In addition, in all cases the surface did not have a continuous coating and the (001) texture was therefore able to form on both sides during cooling and when passing through the α+γ→α phase transition. The C samples therefore show the lowest area proportions of (111) of below 6%. At the same time, it is possible to identify a clear cubic layer fraction (001) of at least 25% to 66%. This favourable preferred orientation also explains why inductions B20 of above 1.72 T and up to 1.80 T are achieved throughout.

The influence of set-up and atmosphere during heat treatment and in the heating, dwell and cooling phases of the heat treatment was examined more closely.

In a first series of tests argon was used. Table 6 gives the B20 and B100 magnetic values, μmax, Hc and Br for the alloy according to the invention after heat treatment in a tube furnace in ceramic annealing powder (embodiments R1, E1, E2, E3, E3, E4) and hanging (embodiments E5, E6, E7). In the free-hanging annealing set-up samples are threaded on a ceramic or thin metal rod and thus very well flushed from all sides.

All the samples were first heated as quickly as possible to 1000° C. and then held at a temperature of 1000° C. for 4 h. They were cooled to an intermediate temperature of 900° C. at 30 K/h and then by furnace cooling, i.e. faster than 30 K/h.

The annealing atmosphere was varied in the individual phases, i.e. in some cases quality 5.0 argon (Ar) was used in addition to dry hydrogen ($H_2$) with a saturation point of −40° C. or below. To provide a better illustration, the same gas atmosphere was used in each of the individual steps, i.e. 'E' indicates the atmosphere in heating phases E(α), E(α+γ) and E(γ), 'H' indicates the dwell phase H(γ) and 'A' indicates the cooling phases A(γ), A(α+γ) and A(α).

TABLE 6

| | R/E | Set-up | E | H | A | B20 in T | B100 in T | $\mu_{max}$ | $H_c$ in A/m | $B_r$ in T |
|---|---|---|---|---|---|---|---|---|---|---|
| Al | R | Powder | Ar | Ar | Ar | 1.672 | 1.955 | 8.887 | 46.6 | 1.28 |
| A2 | E | Powder | H2 | H2 | H2 | 1.791 | 2.031 | 15.075 | 31.8 | 1.40 |
| A3 | E | Powder | Ar | H2 | H2 | 1.804 | 2.042 | 16.306 | 34.2 | 1.45 |
| A4 | E | Powder | Ar | Ar | H2 | 1.798 | 2.038 | 15.095 | 38.9 | 1.47 |
| A5 | E | Powder | H2 | H2 | Ar | 1.740 | 2.006 | 13.654 | 35.1 | 1.37 |
| A6 | E | Hanging | H2 | H2 | H2 | 1.691 | 1.973 | 12.570 | 35.1 | 1.32 |
| A7 | E | Hanging | Ar | H2 | H2 | 1.661 | 1.944 | 11.174 | 37.7 | 1.31 |
| A8 | E | Hanging | Ar | Ar | H2 | 1.768 | 2.013 | 13.263 | 36.5 | 1.42 |

Sample A1 corresponds to an annealing process not in accordance with the invention that took place in argon alone. Sample 1 has a very low B20 induction of 1.672 T, a very low remanence Br of 1.28 T and a high coercive field strength Hc of 46.6 A/m.

In sample A2 according to the invention all annealing was carried out with dry hydrogen flushing. The induction B20 of sample A2 is very high at 1.791 T, as is the remanence Br at 1.40 T. At the same time, the sample has a very low coercive field strength Hc of only 31.8 A/m.

In state A3 according to the invention the protective gas argon was used in the heating phase and dry hydrogen was used for the dwell and cooling phases. The B20, B100, $\mu_{max}$ and, in particular, Br values are higher than the corresponding values for sample A2, which was annealed in hydrogen only. By using Ar alone in the heating phase it was possible to achieve an improvement in the rectangularity of the hysteresis loop. It is assumed that the phase transformations during heating, i.e. α→α+γ→γ, are also dependent on surface energy and so on the gas atmosphere. In contrast to cooling, however, it appears to be advantageous not to completely reduce the surface.

With sample A4 both the dwell phase H(γ) and the heating phases take place in argon. Here, too, the result is very good magnetic values similar to sample A3.

Embodiments A3 and A4 show that compared to annealing in hydrogen alone (sample A2) the partial use of Ar leads to a slight increase in coercive field strength. This is presumably due to less marked grain growth. If lower coercive field strengths are required in the application, downstream grain growth can be initiated by an additional dwell step during cooling in the α-region or downstream heat treatment in the α-region.

With sample A5 the reduction in surface by $H_2$ was carried out in the heating and dwell steps. Cooling took place in argon. Sample A5 has an induction B20 of 1.74 T and a high remanence Br of 1.37 T.

Further embodiments A6 to A8 were annealed hanging. In sample A6 all annealing took place in hydrogen alone. Due to the hanging set-up the sample was very well flushed, leading to a strong reduction in impurities throughout the annealing process. Compared to the powder set-up, however, induction B20 is low at 1.691 T. The high remanence Br of 1.32 T and the high maximum permeability of 12,570 indicate that it was possible to partially suppress the magnetically unfavourable (111) orientation.

With sample A7 the inert gas Ar is used during heating, and dry hydrogen was used for the rest of the annealing process, i.e. for the dwell step and cooling. The resulting magnetic values are actually slightly worse than those for sample E5, which was annealed in hydrogen alone. However, compared to reference sample R1 not according to the invention, remanence Br and maximum permeability $\mu_{max}$ are still slightly higher.

With sample A8 according to the invention argon was used not only during heating but also during the 4-hour dwell phase H(γ). The switch to hydrogen was not made until cooling started. Managing the process in this way made it possible to improve the magnetic properties significantly: induction B20 reaches 1,768 T and remanence Br is 1.42 T.

The embodiments show that the use of $H_2$ during the cooling phase of annealing results in advantageous crystal orientations. $H_2$ should therefore preferably be made available during the cooling phase.

In principle, it is only possible to use hydrogen in the A(α+γ) cooling phase. In practice, however, it is possible when using argon to switch to hydrogen alone at the end of the dwell time so that the entire cooling phase takes place in hydrogen. This ensures that there is sufficient time even in an industrial process to sufficiently flush all the annealing material with hydrogen and so to ensure the reduction of near-surface oxides.

The use of an protective gas during the heating and dwell phases may be favourable in avoiding the formation of an unfavourable intermediate structure. Here, set-ups with very good flushing require longer flushing with argon than less well flushed powder or stacked set-ups.

The results are transferable to mixed gases, i.e. instead of using argon alone it is also possible to use a mixture of argon and hydrogen. For example, a $H_2$/Ar gas mix containing 20 vol. % argon and 80 vol. % hydrogen or an Ar/$H_2$ gas mix containing 80 vol. % hydrogen and 20 vol. % argon can be used. The exact mixture ratio can be adapted depending on annealing set-up, annealing time and flushing conditions.

In a second series of tests nitrogen ($N_2$) is used in the heating and dwell phases. In contrast to Ar, however, $N_2$ is not inert, and annealing in nitrogen can lead to the formation of vanadium nitrides owing to the vanadium content of the alloys claimed.

Vanadium nitrides are preferably deposited at grain boundaries and so prevent grain growth. For this reason the formation of nitrides in soft magnetic alloys is, in principle, undesirable as a fine-grained structure leads to a high coercive field strength Hc. In addition, the presence of deposits generally leads to an increase in Hc since non-magnetic deposits acts as impurities for domain wall movements.

In the context of the present invention, however, the suppression of grain growth during the heating and dwell phases can be regarded as a positive effect, i.e. it opens the possibility of the formation of an intermediate structure advantageous for the further cooling process.

However, at temperatures of 1000° C. and below these deposits are relatively thermodynamically stable, i.e. it is impossible to redissolve the nitrides during the cooling phase in dry hydrogen. This prevents any further grain growth from taking place, which is disadvantageous in terms of coercive field strength.

A compromise can be reached by limiting the amount of deposits, for example by limiting the time during which annealing in nitrogen takes place or by adding only small amounts of nitrogen to the hydrogen.

The variation in annealing atmosphere was carried out in the same manner as for the tests with argon and is illustrated in Table 7.

TABLE 7

| | E/R | Set-up | E | H | A | B20 in T | B100 in T | $\mu_{max}$ | $H_c$ in A/m | $B_r$ in T |
|---|---|---|---|---|---|---|---|---|---|---|
| B1 | R | Powder | N2 | N2 | N2 | 1.617 | 1.933 | 1.624 | 274 | 1.44 |
| B2 | E | Powder | H2 | H2 | H2 | 1.791 | 2.031 | 15.075 | 31.8 | 1.40 |
| B3 | E | Powder | N2 | H2 | H2 | 1.808 | 2.038 | 13.901 | 44.1 | 1.50 |
| B4 | R | Powder | N2 | N2 | H2 | 1.637 | 1.939 | 2.427 | 202 | 1.37 |
| B5 | R | Powder | H2 | H2 | N2 | 1.600 | 1.928 | 1.670 | 225 | 1.37 |
| B6 | E | Hanging | H2 | H2 | H2 | 1.691 | 1.973 | 12.570 | 35.1 | 1.32 |
| B7 | E | Hanging | N2 | H2 | H2 | 1.818 | 2.045 | 13.797 | 40.1 | 1.52 |
| B8 | R | Hanging | N2 | N2 | H2 | 1.637 | 1.939 | 2.427 | 202 | 1.37 |

Sample B1 was subjected to annealing not according to the invention, which took place with $N_2$ flushing throughout. Induction B20 is very low at 1.617 T, as is maximum permeability $\mu_{max}$ at just 1.623. Coercive field strength is very high at 274 A/m.

Sample B2 according to the invention represents reference annealing in hydrogen alone and corresponds to sample A2 from the argon examples.

For sample B3 nitrogen was used in the heating phase and dry hydrogen for the rest of the annealing process. The nitrogen has a positive effect on magnetic parameters B20 and Br which, at 1.808 T and 1.50 T respectively, are both higher than for sample B2, which was annealed in hydrogen alone. The negative effect on coercive field strength Hc was simultaneously minimised by the short nitrogen exposure time, i.e. at 44.1 A/m the Hc is still within an acceptable range for most applications.

With sample B4 not according to the invention both the heating and the dwell phases were carried out in nitrogen. The long nitrogen exposure time results in very poor magnetic parameters, in particular a very low maximum permeability of 2427 and a very high coercive field strength Hc of 202 A/m.

In sample B5, also not according to the invention, a reduction in the surface was first effected by $H_2$ in the heating and dwell steps, with the subsequent cooling step taking place in nitrogen. The resulting magnetic values are as poor as for state B4. This embodiment shows that the surface of the material must be free of nitrides and other occupations as well as free of oxides for the cooling process.

Further embodiments B6 to B8 were annealed hanging.

Sample B6 was annealed free hanging in hydrogen alone and corresponds to sample A6 from the argon embodiments. Owing to good flushing, however, the induction B20 is low at only 1.691 T despite the high maximum permeability.

Sample B7 was also annealed hanging, but nitrogen was used during the heating phase. Surprisingly, it shows a very clear increase in induction B20 at 1.818 T and a very high remanence Br of 1.52 T. It is assumed that the nitrides produced during the heating phase inhibit grain growth so that despite very good flushing with hydrogen during the dwell phase a favourable intermediate structure is created, permitting the preferable formation of the (001) orientation or the suppression of the (111) orientation during the cooling phase.

Sample B8 not according to the invention was annealed in the same way as sample B7, with the dwell phase as well as the heating phase being carried out in nitrogen. Similarly to example B4, the negative influence of the nitrogen therefore predominates, and the desired magnetic properties can no longer be set. In particular, coercive field strength is clearly too high at 202 A/m.

The embodiments show that nitrogen in small amounts can be advantageous in increasing induction B20 and remanence Br. If nitrogen is provided in too large an amount or over too long a period during annealing, however, the deterioration in Hc is too great.

Optionally, a dwell step can be arranged after the cooling phase A(α+γ) but still in the ferritic α-region. This is designed to further promote grain growth, leading to a further drop in coercive field strength Hc and a further increase in maximum permeability.

Alternatively, this optional dwell step may also take place in a second heat treatment process that takes place entirely in the α-region. This downstream heat treatment makes it possible to improve part of the originally annealed material only, e.g. the part that does not meet all the magnetic requirements after initial annealing in the γ-region.

Table 8 shows some embodiments that indicate the influence of a second heat treatment process in the α-region. Lines C1 to C5 correspond to the states after heat treatment in the γ-region with a 4-hour dwell step at 1000° C. Lines C1' to C5' show the same samples subjected to a second heat treatment process in the α-region with a 4-hour dwell step at 930° C.

TABLE 8

| | E/R | Annealing | E | H | A | B20 in T | B100 in T | $\mu_{max}$ | $H_c$ in A/m | $B_r$ in T |
|---|---|---|---|---|---|---|---|---|---|---|
| C1 | E | 4 h 1000° C. | H2 | H2 | H2 | 1.691 | 1.973 | 12.570 | 35.1 | 1.32 |
| C1' | E | 4 h 930° C. | H2 | H2 | H2 | 1.695 | 1.967 | 14.805 | 33.0 | 1.38 |
| C2 | E | 4 h 1000° C. | Ar | H2 | H2 | 1.804 | 2.042 | 16.306 | 34.2 | 1.45 |
| C2' | E | 4 h 930° C. | H2 | H2 | H2 | 1.802 | 2.039 | 20.238 | 29.2 | 1.51 |
| C3 | E | 4 h 1000° C. | N2 | H2 | H2 | 1.776 | 2.017 | 6.267 | 84.2 | 1.47 |
| C3' | E | 4 h 930° C. | H2 | H2 | H2 | 1.780 | 2.019 | 7.747 | 77.1 | 1.54 |
| C4 | R | 4 h 1000° C. | N2 | N2 | N2 | 1.617 | 1.933 | 1.624 | 274 | 1.44 |
| C4' | R | 4 h 930° C. | H2 | H2 | H2 | 1.458 | 1.731 | 1.761 | 250 | 1.32 |
| C5 | R | 4 h 1000° C. | Ar | Ar | Ar | 1.672 | 1.955 | 8.887 | 46.6 | 1.28 |
| C5' | R | 4 h 930° C. | H2 | H2 | H2 | 1.674 | 1.953 | 11.344 | 44.1 | 1.37 |

Example C1 corresponds to sample A6 already presented. Although permeability $\mu_{max}$ is high and Hc is low owing to the hanging annealing set-up in hydrogen alone, induction B20 is relatively low. Not even subsequent annealing in the α-region as for sample C1' leads to any substantial improvement in B20.

Example C2 corresponds to sample A3 as explained above, which was annealed in Ar in the heating phase. The partial use of Ar results in very good magnetic values. The downstream heat treatment in the α-region, as shown for example C2', leads to a further clear drop in Hc to 29.2 A/m and a clear increase in maximum permeability to 20,238.

Examples C3 and C3' show the influence of second heat treatment process on a sample that had been annealed in nitrogen in the first heat treatment process in the heating phase. All the magnetic parameters listed improve slightly, with maximum permeability remaining relatively low at 7747 and coercive field strength remaining relatively high at 77.1 A/m even after this heat treatment.

Reference example C4 not according to the invention was annealed in nitrogen alone during the first heat treatment process. It proved impossible to achieve the magnetic parameters required by dispensing with hydrogen, and the long presence of nitrogen during annealing resulted, in particular, in a very high Hc of 274 A/m. This is presumably due to the formation of nitrides on the surface and in the material. The heat treatment at 930° C. carried out on example C4' was unable to dissolve these nitrides and it is therefore impossible to further improve the magnetic values.

Reference example C5 corresponds to example A1, i.e. annealing not according to the invention in Ar alone. This subsequent annealing failed to achieve any substantial improvement in magnetic characteristics in example C5'.

The examples show that the second heat treatment is effective in particular in samples in which the heat treatment took place in the γ-region partially in Ar.

In industrial-scale production preliminary products are customarily coated with a ceramic layer to prevent them from sticking together, and there is electrical insulation between the layers to minimise eddy current losses. Preliminary products in the form of strips or sheets or laminations are stacked with a ceramic layer arranged between the strips or sheets.

Surprisingly, it has been found that with heat treatment at temperatures above the transition temperature $T_{\alpha+\gamma/\gamma}$, and thus in the FCC- or γ-phase region, magnetic properties are dependent on the fraction of the surface of the preliminary product exposed. However, if a fraction of the preliminary product is at least temporarily in direct contact with the hydrogen-containing atmosphere during heat treatment, good magnetic properties can be achieved more reliably. It has been found that these good magnetic properties are related to the formation of a texture in the soft magnetic alloy.

As a result, the preliminary product is only partially coated with the ceramic-forming layer that transforms into a ceramic layer during subsequent heat treatment. If the preliminary product is planar, for example has the form of a sheet or strip or a lamination, one or both of the opposite main surfaces is/are partially coated so that parts of one or both opposite main surfaces are free of the coating during heat treatment.

The preliminary product is partially coated with a ceramic-forming layer with 20% to 80% of the total surface of the preliminary product remaining free of the ceramic-forming layer. The partially coated preliminary product is then heat treated. The coating applied may, for example, be a sol containing metal ions so that no ceramic is yet present in the form applied. It is also possible for the layer to contain ceramic nanoparticles in the form of a sol.

In some embodiments the preliminary product is planar and has the form of a sheet or a lamination having a first surface and a second surface that opposes the first surface surface, at least between 20 and 80%, preferably between 30% and 70%, particularly preferably between 50% and 70% of the first surface and between 20% and 80%, preferably between 30% and 70%, particularly preferably between 50% and 70% of the second surface being free of the ceramic layer that contains the metal oxide or metal hydroxide.

Ceramic strip coatings are used on Fe—Co strips in order to prevent touching metal surfaces from fusing together during the necessary magnetic final annealing of sheets or laminations. Examples include the Mg-methylate-based DL1 coating that transforms into magnesium oxide during annealing and the Zr-propylate-based HITCOAT coating that transforms into zirconium oxide during annealing. After annealing, both coatings are present in the form of a thin film with a typical thickness of 0.5 μm or thinner on each side. As the coatings are applied in a highly fluid state with a solvent, they spread evenly over the strip surface and form a continuous coating.

One effect of the coating on soft magnetic properties in the Fe—Co material class was surprising. Contrary to expectations and despite their relatively thin thickness, the coatings resulted in a substantial improvement in remagnetisation losses because the electrical insulation leads to a reduction in eddy currents.

If, however, a strip of the VACOFLUX X1 alloy is coated on both sides with one of these coatings and the sample is annealed in the γ-region in a powder set-up, in contrast to an uncoated reference probe, no marked cube face texture is found to be produced.

This can be seen from the examples listed in Table 9, which shows magnetic properties after final annealing for 4 h at 1000° C. dependent on coating. The table gives the magnetic parameters $\mu_{max}$, B3, B20, B100, Hc and Br for various coating variants. All tests were carried out on charge 7410163B, which has already been described at various points above, at a strip thickness of 0.20 mm. Rings measuring 28.5 mm×20.0 mm were punched out of the strips and annealed in a chamber furnace at 1000° C. for a 4 h dwell time with dry hydrogen flushing. The set-up was 'stacked', i.e. approx. 20 rings were stacked one on top of another, placed on a ceramic base plate and covered with a ceramic covering plate to ensure they were still flat after annealing.

TABLE 9

| # | Variant | $\mu_{max}$ | B3 in T | B20 in T | B100 in T | Hc in A/m | Br in T |
|---|---|---|---|---|---|---|---|
| E | Uncoated | 12.814 | 1.537 | 1.770 | 2.020 | 37.3 | 1.43 |
| F | HITCOAT on both sides | 10.240 | 1.437 | 1.687 | 1.963 | 46.4 | 1.36 |
| G | HITCOAT on both sides, one side thin | 10.793 | 1.468 | 1.719 | 1.986 | 43.3 | 1.34 |
| H | HITCOAT on one side | 12.467 | 1.493 | 1.737 | 2.001 | 39.8 | 1.39 |

Example E represents the uncoated reference sample. Annealing results in very good soft magnetic properties. The very high induction B20 of 1.77 T, in particular, is an indicator of a very high cube face texture (001)[uvw] fraction, which is successfully formed by the annealing in the γ-region. The advantageous orientation also results in a very high maximum permeability of almost 13,000 and a low coercive field strength Hc of only 37.3 A/m.

In example F the strip was provided with a zirconium propylate coating on both sides before punching. During annealing this transforms into surface zirconium oxide. This dense covering suppressed the formation of the cube face texture, resulting in an induction B20 of just 1.687 T. At Hc 46.4 A/m, coercive field strength is also clearly above the value of reference sample E.

To permit the formation of the cube face texture while still achieving sufficient separation of the sheets during annealing, it is nevertheless possible to use one of the aforementioned coatings (DL1 or HITCOAT) as long as it is sufficiently thin and as long as the coating is applied to one side of the strip only.

In example G the strip was first coated in the normal way, i.e. on both sides, and then the coating was chemically removed from one side using a solvent. The exposed side was then recoated with a highly diluted coating solution such that one side only of the strip was coated in the normal manner with a coating thickness of 100 nm and 500 nm, while the second side had only a very thin coating in the region below 100 nm. After annealing, the soft magnetic properties of this sample were better than those of the normal thicker coating in example B. However, at 1.719 T the induction B(20) was still clearly below the reference value of the uncoated sample. In addition, the very thin coating leads to first adhesions during annealing, i.e. the main function of the coating, layer separation, is severely impaired.

In example H a strip was first coated normally and the coating was then chemically removed on one side using a solvent. Annealing resulted in magnetic properties that indicate that a substantial fraction of cube face texture could be formed. In addition to a high induction B20 of 1.737 T, maximum permeability of a scant 12,500 was achieved, almost corresponding to reference state A.

The examples show that the following gradation applies in terms of setting a high induction B20:

$$B20(\text{uncoated}) \geq B20(\text{one side}) \geq B20(\text{both sides})$$

One-sided coating therefore makes it possible to anneal stacked sheets. This is subject to the sheets being placed one on top of another in a specific orientation, i.e. with the coated sides of the sheets always facing upwards, for example, so that there is no contact between the coated and uncoated sides of the sheets. Adjacent to the base plate, and to the covering plate where one is used, it may be necessary to use a sheet coated on both sides as a separating layer. Other processes can also be used to effect this one-sided strip coating.

In one example as the coating is being applied by rolling, the coating on one side is squeezed under pressure by a flat ground roller. This process can be carried out on a machine that is also used for coating on both sides.

In a further example the strip is coated in the normal way, i.e. applied uniformly to both sides. The coating on one side is then removed by mechanical brushing.

The results of annealing in annealing powder show that the presence of a surface layer of loose ceramic particles is entirely compatible with the formation of a cube face texture by annealing in the γ-region in order to achieve good magnetic properties reliably. Loose powders are unfavourable in industrial-scale manufacture, however, because the powder particles can become detached during handling. On one hand, this results in quality problems, on the other breathing in the particles can represent a health hazard. Furthermore, ceramic oxides are very hard and so lead to very quick tool wear during punching processes. If the particles are too big, they can clog punching tool clearances and so cause damage. Even with powders with a median size distribution in the low μm range, single grains with sizes>10 μm can lead to a disproportionately strong increase in the fill factor within a laminated core.

As a result, a coating with good adherence consisting of very fine plastic bonded particles has been developed in which the particles do not transform into a thermally stable ceramic oxide until final annealing.

The particles used are aluminium oxide hydroxide (boehmite) with a size of 10 to 300 nm, preferably 20 to 150 nm, in a binding agent based on aqueous acrylate dispersions that also contains wetting agents and ammonia as further components for setting and monitoring the pH value and disperses by filling with purified water.

The dispersion thus created is applied by means of profiled rollers in a continuous process to both sides of a VACOFLUX X1 strip with a thickness of 0.20 mm, thereby creating a striped structure in the rolling gap. The viscosity of the coating dispersion is set by means of the ceramic fraction and, optionally, by an additional rheologically active additive such that these stripes run only very slightly or not at all on leaving the rolling gap. In the subsequent drying step the coated strip is dried with warm air (280° C.), causing the binding agent to form a film. The strip then has a coating with good adherence and a striped structure.

This coating achieves the following:

- the surface is only partial covered,
- the particle size is in a range below 1 μm,
- the fine particles are bound in the preliminary step,
- the aluminium is present in the preliminary step as soft boehmite (3,5 on the Mohs scale) and does not transform into hard $Al_2O_3$ (9 on the Mohs scale) until final annealing.

By varying the process, for example, changing the viscosity by adapting the boehmite fraction and/or changing the roller profile, it is, in principle, possible to set other structures with similar properties on the strip.

Figure 15:
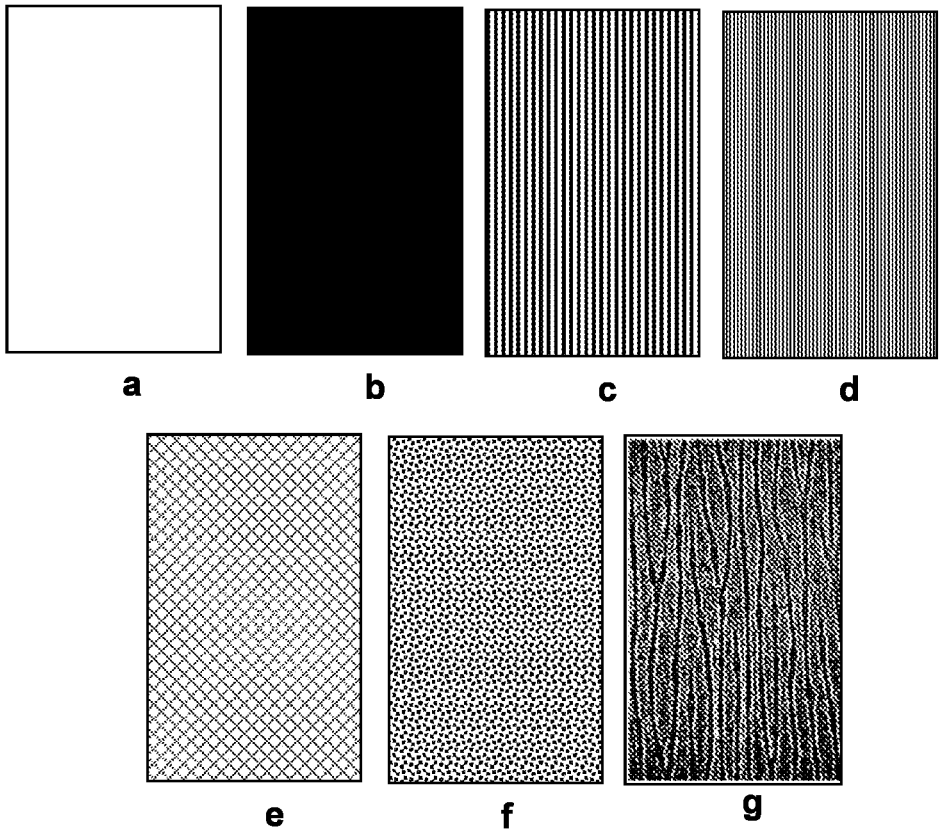
FIG. 15 shows exemplary images of surface patterns of a structured coating.

FIG. 15 shows exemplary images of surface patterns, examples a, b showing reference states and the other examples surfaces according to the invention.

Example a shows a sheet with no coating. While the formation of a cube face texture is possible here, uncoated sheets cannot be annealed without further processing because they fuse together at the high temperatures used, typically above 900° C., and because the annealing of laminated cores made of such sheets results in increased eddy current losses due to this layer fusion.

Example b shows a discontinuous complete coating. This corresponds to coatings such as HITCOAT and DL1. While it is also possible to achieve very good layer separation with final annealing in the γ-region with this type of coating, it is impossible to form a significant fraction of cube face texture.

Example c shows a striped structure. The dark stripes correspond to regions with a very dense covering of Al-containing particles. The light regions between the stripes contain no or very few particles, and these layers therefore typically appear to be transparent. Naturally, binding agent may also occur in the intermediate regions in the unannealed state.

Example d also shows a striped structure. In contrast to example c, the dark stripes enriched with Al particles are narrower. This permits a particular formation of cube face structure but increases the risk of sheet adherence due to annealing Example e shows a lattice structure in which the lines run diagonally to the strip direction.

Example f shows a coating in which local accumulations of particles have formed surrounded by exposed areas. The particles are bonded before annealing so that the coating adheres.

Example g shows in schematic form the appearance of a coating that has actually been applied. The dispersion used for coating had a lower viscosity than that used in examples c and d and the coating therefore had more time to run laterally after application. The result is a striped pattern with ramifications. This image also shows that in practice the exposed areas, which appear completely white in this idealised view, still contain a fraction of fine Al particle. However, the concentration in these regions is very small compared to the thick stripes.

Some of these abstract surface structures were produced in the form of the embodiments listed in Table 10, which shows the magnetic parameters of coated samples after final annealing for 4 h at 1000° C., $H_2$, with a heating rate of 900° C. to 1000° C. at 20 K/h and a cooling rate of 1000° C. to 900° C. at 20 K/h.

Sample #2 represents the reference sample with a continuous complete coating, i.e. as shown in image b. The strip was previously coated on both sides with HITCOAT, a zirconium-propylate-based coating that is present after final annealing as ceramic zirconium oxide. As the entire surface is covered here, the preferred formation of a cube face texture does not take place. This is expressed by a very low induction B20 of 1.687 T.

Sample #3 and sample #4 were coated with the new TX1 coating but do not correspond to the invention owing to the dense surface.

The approach adopted with sample #3 showed a relatively high ceramic fraction of 11%. The coating was applied in a laboratory test by manual application using a profiled roller. This composition and application method resulted in thick stripes, similar to surface image c, but the high concentration in combination with the low application pressure also led to a dense base covering between the stripes, meaning that overall this state also corresponds to surface image b. Here, too, the continuous complete coating seen in sample #2 results in a very low induction with a B20 of 1.663 T after final annealing.

In sample #4 a lower ceramic fraction of 7% was selected. At this concentration the coating runs out of the rolling gap on exit, resulting in a continuous coating as shown in surface image b. The induction B20 after final annealing was therefore only 1.696 T.

Samples #5, #6, #7 and #8 represent states according to the invention. In all of these states it was possible to separate the sheets after annealing without any damage.

TABLE 10

| # | Image | $T_{max}$ in ° C. | Identifier | B3 in T | B20 in T | B100 in T | $\mu_{max}$ | Hc in A/m | Br in T |
|---|---|---|---|---|---|---|---|---|---|
| 1 | a | 1000 | 1901543 | 1.537 | 1.770 | 2.020 | 12.814 | 37.3 | 1.43 |
| 2 | b | 1000 | 2001969 | 1.437 | 1.687 | 1.963 | 10.240 | 46.4 | 1.36 |
| 3 | b | 1000 | 2000230 | 1.406 | 1.663 | 1.940 | 11.417 | 48.1 | 1.38 |
| 4 | b | 1000 | 2000231 | 1.437 | 1.696 | 1.956 | 12.148 | 46.7 | 1.38 |
| 5 | f | 1000 | 2000200 | 1.507 | 1.734 | 1.998 | 14.523 | 39.9 | 1.42 |
| 6 | g | 1000 | 2000252 | 1.502 | 1.732 | 1.995 | 12.959 | 42.2 | 1.41 |
| 7 | d | 1000 | 2001968 | 1.493 | 1.727 | 1.995 | 12.694 | 40.8 | 1.40 |
| 8 | d | 1100 | 2002008 | 1.537 | 1.755 | 2.016 | 14046.6 | 35.8 | 1.39 |

In all cases VACOFLUX X1 from charge 7610163B with a strip thickness of 0.20 mm was used as the base material. Punched rings measuring 28.5 mm×20.0 mm were produced for each coating state.

20 rings were placed one on top of another in a stack, positioned on a ceramic plate, weighted down with a ceramic plate and annealed in a chamber furnace with dry hydrogen flushing. All annealing took place at a temperature $T_{max}$ of at least 1000° C. in the γ-region so that if the surface was oxide-free it was possible to form a cube face texture during cooling through the α+γ intermediate phase region. The indicator for the presence of a significant fraction of cube face texture is an induction value B20=B(20 A/cm) of at least 1.70 T, preferably at least 1.74 T.

Magnetic induction B3=B(3 A/cm), B20, B100, maximum permeability $\mu_{max}$, coercive field strength Hc and remanence Br were measured in accordance with standard IEC 60404-4.

Sample #1 represents the uncoated reference sample. It is here that the highest fraction of cube face texture (001)[uvw] is able to form during annealing owing to the completely exposed surface. Induction B20 is 1.770 T. However, these sheets cannot be annealed in contact with one another due to the lack of coating.

Sample #5 was coated using the same approach as sample #3, i.e. with a ceramic fraction of 11%. Here, however, the strip was passed through two profiled rollers with an application pressure of 2 bar. This resulted in striped surface image d. Owing to the partially exposed surface, an appreciable fraction of cube face texture was able to form during final annealing with induction B20 at 1.734 T.

As for sample #4, a lower ceramic fraction of 7% was selected for sample #6. In order to obtain a non-complete coating despite the lower ceramic fraction, an additional additive was added to the coating to increase basic viscosity. This change made it possible to produce a non-complete coating as shown in image g. Here, once again, the induction value B20 was high at 1.732 T.

For sample #7 the ceramic fraction was reduced still further, i.e. to 4%, and an additive was added as for sample #6. The surface appearance corresponded to image d, i.e. fine, clearly separated lines. The induction B20 of 1.727 T is due to the formation of the cube face texture.

Finally, sample #8 shows that it is even possible to further increase the annealing temperature due to the very good layer insulation of the coating. An increase in annealing temperature can be advantageous when annealing in stacks. In this particular case, a strip with the same coating as sample #7 (4% ceramic fraction+additive) was annealed at an increased dwell temperature of 1100° C. in the γ-region with the same dwell time of 4 h. This results in a higher induction B20 of 1.755 T than in the other examples according to the invention.

The embodiments illustrate that rather than being decisive in the formation of cube face texture, coating chemistry is, in fact, an aid to setting the right surface covering. The important thing is that the coating should be present as a non-continuous layer interspersed with exposed surface regions after annealing.

Figure 16:
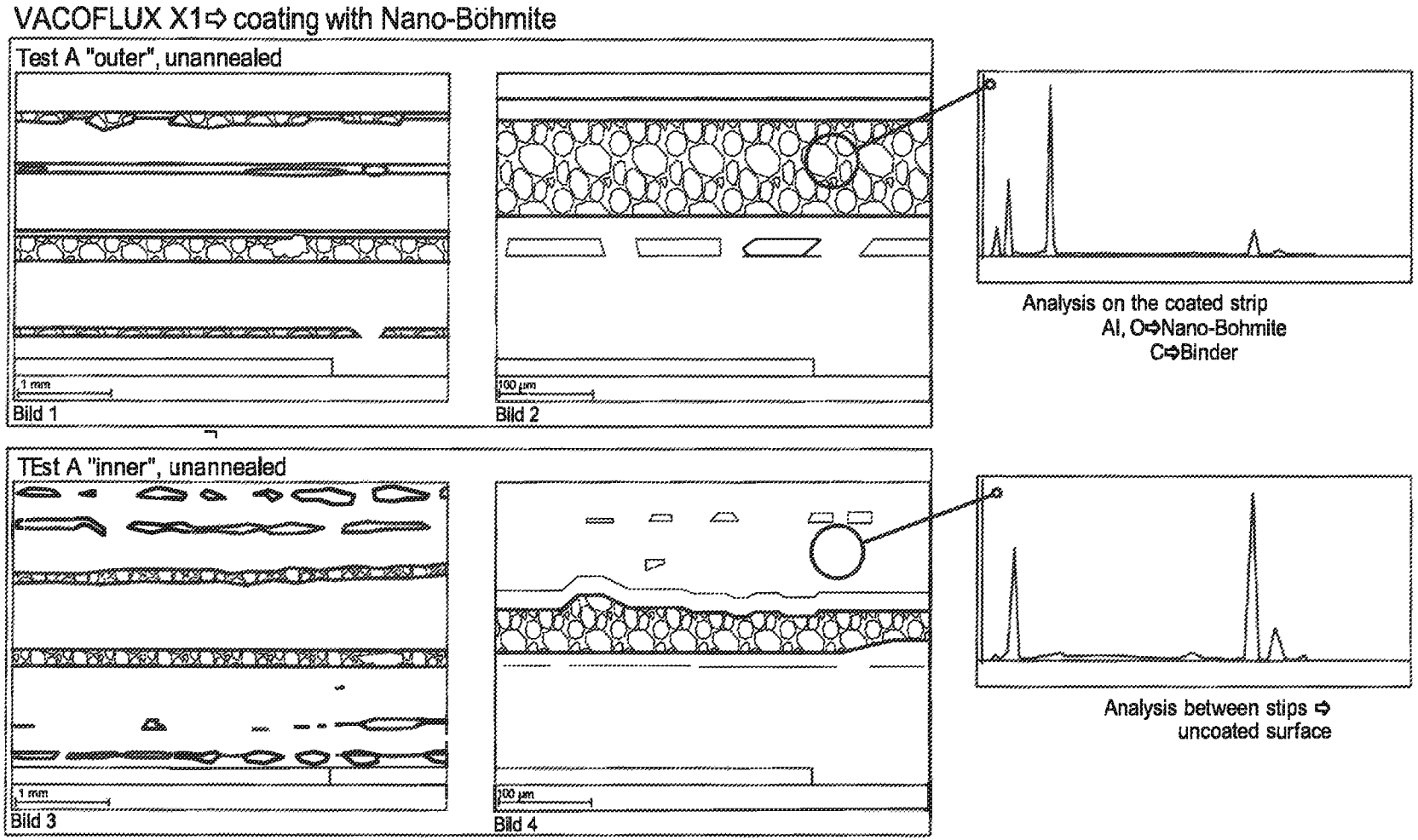
FIG. 16 shows EDX analyses for a striped coating of the surface before and after annealing.

This is illustrated in the example according to the invention in FIG. 16. FIG. 16 shows an example of a striped surface following coating with TX1, 11% ceramic (sample #5 according to the invention). Before annealing (top row), analysis of the coating stripes shows fractions of ceramic (Al and O) and binding agent (C). After annealing (bottom row), EDX analysis also shows a coating-free surface, i.e. with only elements of the base VACOFLUX X1 material between the stripes.

Figure 17:
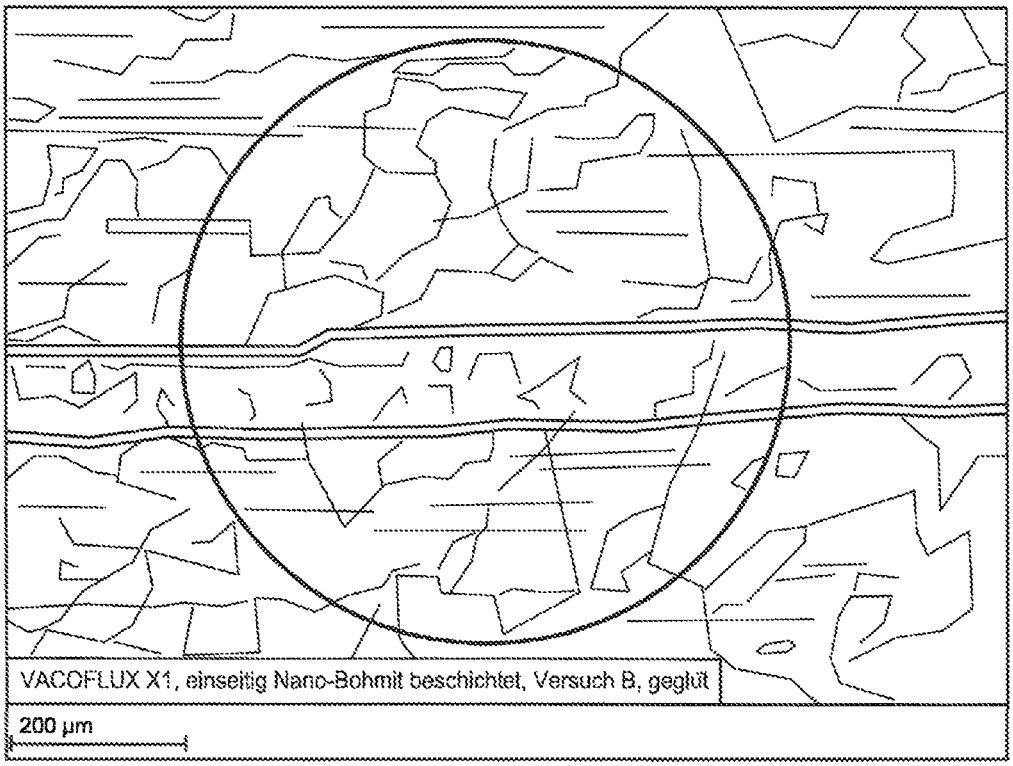
FIG. 17 shows the ratio of stripe width to grain size in the annealed state using an example.

FIG. 17 shows a picture of a coating stripe of TX1 (11% ceramic) after final annealing (sample #5 according to the invention). The coated regions are narrower than the grains produced and so there is sufficient exposed surface within each grain and the formation of the cube face texture is possible.

The invention claimed is:

1. A method for producing a soft magnetic alloy, the method comprising:

providing a preliminary product having a composition that consists of:

| | | | | |
|---|---|---|---|---|
| 2 wt % | ≤ | Co | ≤ | 30 wt % |
| 0.3 wt % | ≤ | V | ≤ | 5.0 wt % |
| 0 wt % | ≤ | Cr | ≤ | 3.0 wt % |
| 0 wt % | ≤ | Si | ≤ | 5.0 wt % |
| 0 wt % | ≤ | Mn | ≤ | 5.0 wt % |
| 0 wt % | ≤ | Al | ≤ | 3.0 wt % |
| 0 wt % | ≤ | Ta | ≤ | 0.5 wt % |
| 0 wt % | ≤ | Ni | ≤ | 1.0 wt % |
| 0 wt % | ≤ | Mo | ≤ | 0.5 wt % |
| 0 wt % | ≤ | Cu | ≤ | 0.2 wt % |
| 0 wt % | ≤ | Nb | ≤ | 0.25 wt % |
| 0 wt % | ≤ | Ti | ≤ | 0.05 wt % |
| 0 wt % | ≤ | Ce | ≤ | 0.05 wt % |
| 0 wt % | ≤ | Ca | ≤ | 0.05 wt % |
| 0 wt % | ≤ | Mg | ≤ | 0.05 wt % |
| 0 wt % | ≤ | C | ≤ | 0.02 wt % |
| 0 wt % | ≤ | Zr | ≤ | 0.1 wt % |
| 0 wt % | ≤ | O | ≤ | 0.025 wt % |
| 0 wt % | ≤ | S | ≤ | 0.015 wt % |

the rest iron and up to 0.2 wt % of other impurities due to melting, the preliminary product having a phase transition from a BCC-phase region to a mixed BCC/FCC region to an FCC-phase region, wherein as the temperature increases the phase transition between the BCC-phase region and the mixed BCC/FCC-region takes place at a first transition temperature $T_{\alpha/\alpha+\gamma}$ and as the temperature continues to increase the transition between the mixed BCC/FCC-region and the FCC-phase region takes place at a second transition temperature $T_{\alpha+\gamma/\gamma}$, wherein $T_{\alpha+\gamma/\gamma}>T_{\alpha/\alpha+\gamma}$ and the difference $T_{\alpha+\gamma/\gamma}-T_{\alpha/\alpha+\gamma}$ is less than 45K, partially coating the preliminary product with a ceramic-forming layer, the preliminary product comprising a planar form having a first surface and a second surface opposing the first surface, between 20% and 80% of the first surface and between 20% and 80% of the second surface remaining free of the ceramic-forming layer, heat treating the partially coated preliminary product, the heat treating comprising:

heating up the preliminary product and then heat treating the preliminary product in a first step for a total time $t_1$, in this first step the preliminary product being heat treated at a temperature within a temperature range between $T_{\alpha+\gamma/\gamma}$ and $T_1$ and then cooling the preliminary product from a temperature range between $T_{\alpha+\gamma/\gamma}$ and $T_1$ to room temperature to form the soft magnetic alloy, $T_{\alpha+\gamma/\gamma}\leq T_1\leq 1100°$ C., and $t_1$ referring to the total time at temperature above $T_{\alpha+\gamma/\gamma}$, wherein the temperature $T_1$ and temperatures which are equal to the temperature $T_1\pm 20°$ C. lie above $T_{\alpha+\gamma/\gamma}$, wherein the heat treating is carried out at least partially in a hydrogen-containing atmosphere, during which the exposed parts of the surface of the preliminary product are in direct contact with the hydrogen-containing atmosphere, or heating up the preliminary product and then heat treating the preliminary product in a first step for a total time $t_1$, in this first step the preliminary product being heat treated at a temperature within a temperature range between $T_{\alpha+\gamma/\gamma}$ and $T_1$ and then cooling the preliminary product from a temperature range between $T_{\alpha+\gamma/\gamma}$ and $T_1$ to a temperature $T_2$, and immediately thereafter heat treating the preliminary product in a second step at temperature $T_2$ for a time $t_2$, and then cooling the preliminary product from $T_2$ to room temperature to form the soft magnetic alloy, with $T_1>T_2$, $T_2$ being below $T_{\alpha/\alpha+\gamma}$, $T_{\alpha+\gamma/\gamma}\leq T_1 1100°$ C., and $t_1$ referring to the total time at temperatures is above $T_{\alpha+\gamma/\gamma}$, cooling the preliminary product from $T_2$ to room temperature to form the soft magnetic alloy, with $T_1>T_2$, $T_2$ being below $T_{\alpha/\alpha+\gamma}$, $T_{\alpha+\gamma/\gamma}<T_1\leq 1100°$ C., and $t_1$ referring to the total time at temperatures is above $T_{\alpha+\gamma/\gamma}$, wherein the temperature $T_1$ and temperatures which are equal to the temperature $T_1\pm 20°$ C. lie above $T_{\alpha+\gamma/\gamma}$, and wherein the temperature $T_2$ and temperatures which are equal to the temperature $T_2\pm 20°$ C. lie below $T_{\alpha/\alpha\pm\gamma}$, wherein the heat treating is carried out at least partially in a hydrogen-containing atmosphere, during which the exposed parts of the surface of the preliminary product are in direct contact with the hydrogen-containing atmosphere.

2. A method for producing a soft magnetic alloy, the method comprising:

providing a preliminary product having a composition that consists of:

| | | | | |
|---|---|---|---|---|
| 5 wt % | ≤ | Co | ≤ | 25 wt % |
| 0.3 wt % | ≤ | V | ≤ | 5.0 wt % |
| 0 wt % | ≤ | Cr | ≤ | 3.0 wt % |
| 0 wt % | ≤ | Si | ≤ | 3.0 wt % |
| 0 wt % | ≤ | Mn | ≤ | 3.0 wt % |
| 0 wt % | ≤ | Al | ≤ | 3.0 wt % |
| 0 wt % | ≤ | Ta | ≤ | 0.5 wt % |
| 0 wt % | ≤ | Ni | ≤ | 0.5 wt % |
| 0 wt % | ≤ | Mo | ≤ | 0.5 wt % |
| 0 wt % | ≤ | Cu | ≤ | 0.2 wt % |
| 0 wt % | ≤ | Nb | ≤ | 0.25 wt % |

-continued

| | | | | |
|---|---|---|---|---|
| 0 wt % | ≤ | Ti | ≤ | 0.05 wt % |
| 0 wt % | ≤ | Ce | ≤ | 0.05 wt % |
| 0 wt % | ≤ | Ca | ≤ | 0.05 wt % |
| 0 wt % | ≤ | Mg | ≤ | 0.05 wt % |
| 0 wt % | ≤ | C | ≤ | 0.02 wt % |
| 0 wt % | ≤ | Zr | ≤ | 0.1 wt % |
| 0 wt % | ≤ | O | ≤ | 0.025 wt % |
| 0 wt % | ≤ | S | ≤ | 0.015 wt % |

the rest iron and up to 0.2 wt % of other impurities due to melting, the preliminary product having a phase transition from a BCC-phase region to a mixed BCC/FCC region to an FCC-phase region, wherein as the temperature increases the phase transition between the BCC-phase region and the mixed BCC/FCC-region takes place at a first transition temperature $T_{\alpha/\alpha+\gamma}$ and as the temperature continues to increase the transition between the mixed BCC/FCC-region and the FCC-phase region takes place at a second transition temperature $T_{\alpha+\gamma/\gamma}$, wherein $T_{\alpha+\gamma/\gamma}>T_{\alpha/\alpha+\gamma}$ and the difference $T_{\alpha+\gamma/\gamma}-T_{\alpha/\alpha+\gamma}$ is less than 45K, partially coating the preliminary product with a ceramic-forming layer, the preliminary product comprising a planar form having a first surface and a second surface opposing the first surface, between 20% and 80% of the first surface and between 20% and 80% of the second surface remaining free of the ceramic-forming layer, heat treating the partially coated preliminary product, the heat treating comprising:

heating up the preliminary product and then heat treating the preliminary product in a first step for a total time $t_1$, in this first step the preliminary product being heat treated at a temperature within a temperature range between $T_{\alpha+\gamma/\gamma}$ and $T_1$ and then cooling the preliminary product from a temperature range between $T_{\alpha+\gamma/\gamma}$ and $T_1$ to a temperature $T_2$, and immediately thereafter heat treating the preliminary product in a second step at temperature $T_2$ for a time $t_2$, wherein 30 minutes$\leq t_2 \leq$20 hours, and then cooling the preliminary product from $T_2$ to room temperature to form the soft magnetic alloy, with $T_1>T_2$, $T_2$ being below $T_{\alpha/\alpha+\gamma}$, $T_{\alpha+\gamma/\gamma}T_1\leq$1100° C., and $t_1$ referring to the total time at temperatures is above $T_{\alpha+\gamma/\gamma}$, wherein the temperature $T_1$ and temperatures which are equal to the temperature $T_1$±20° C. lie above $T_{\alpha\gamma/\gamma}$, and wherein the temperature $T_2$ and temperatures which are equal to the temperature $T_2$±20° C. lie below $T_{\alpha/\alpha+\gamma}$, wherein the heat treating is carried out at least partially in a hydrogen-containing atmosphere, during which the exposed parts of the surface of the preliminary product are in direct contact with the hydrogen-containing atmosphere.

3. A method for producing a soft magnetic alloy according to claim 1, the preliminary product having a composition that consists of:

| | | | | |
|---|---|---|---|---|
| 5 wt % | ≤ | Co | ≤ | 25 wt % |
| 0.3 wt % | ≤ | V | ≤ | 5.0 wt % |
| 0 wt % | ≤ | Cr | ≤ | 3.0 wt % |
| 0 wt % | ≤ | Si | ≤ | 3.0 wt % |
| 0 wt % | ≤ | Mn | ≤ | 3.0 wt % |
| 0 wt % | ≤ | Al | ≤ | 3.0 wt % |
| 0 wt % | ≤ | Ta | ≤ | 0.5 wt % |

-continued

| | | | | |
|---|---|---|---|---|
| 0 wt % | ≤ | Ni | ≤ | 0.5 wt % |
| 0 wt % | ≤ | Mo | ≤ | 0.5 wt % |
| 0 wt % | ≤ | Cu | ≤ | 0.2 wt % |
| 0 wt % | ≤ | Nb | ≤ | 0.25 wt % |
| 0 wt % | ≤ | Ti | ≤ | 0.05 wt % |
| 0 wt % | ≤ | Ce | ≤ | 0.05 wt % |
| 0 wt % | ≤ | Ca | ≤ | 0.05 wt % |
| 0 wt % | ≤ | Mg | ≤ | 0.05 wt % |
| 0 wt % | ≤ | C | ≤ | 0.02 wt % |
| 0 wt % | ≤ | Zr | ≤ | 0.1 wt % |
| 0 wt % | ≤ | O | ≤ | 0.025 wt % |
| 0 wt % | ≤ | S | ≤ | 0.015 wt % |

the rest iron, where Cr+Si+Al+Mn≤3.0 wt %, and up to 0.2 wt % of other impurities due to melting.

4. A method according to claim 1, wherein the ceramic-forming layer is applied to the preliminary product in the form of a pattern of stripes or dots, or a network or a mesh.

5. A method according to claim 1, wherein the maximum width of coated regions of the preliminary product is less than 2 mm.

6. A method according to claim 1, wherein the ceramic-forming layer comprises a hydrated metal oxide and/or a metal oxide and/or a metal hydroxide.

7. A method according to claim 1, wherein during the heating of the preliminary product in the temperature range from $T_{\alpha/\alpha+\gamma}$to $T_1$ the heating takes place in a protective gas atmosphere containing less than 5 vol. % hydrogen.

8. A method according to claim 1, wherein the heating of the preliminary product in the first step is carried out for the total time $t_1$ in an protective gas atmosphere containing less than 5 vol. % hydrogen.

9. A method according to claim 1, wherein the cooling of the preliminary product from $T_1$ to $T_2$ is carried out in a hydrogen-containing atmosphere.

10. A method according to claim 1, wherein the cooling of the preliminary product from $T_1$ to room temperature is carried out in a hydrogen-containing atmosphere.

11. A method according to claim 1, wherein $T_{\alpha+\gamma/\gamma}\leq T_1\leq T_{\alpha\gamma/\gamma}$+50° C. and 5 minutes $\leq t_1\leq$10 hours, and 700° C.$\leq T_2\leq$1050° C. and 30 minutes $\leq t_2\leq$20 hours.

12. A method according to claim 1, wherein the heat treatment further comprises a subsequent final annealing in a hydrogen-containing protective gas atmosphere that is carried out at a maximum temperature that is below the first transition temperature $T_{\alpha/\alpha+\gamma}$.

13. A method according to claim 1, after heat treatment the alloy having an area proportion of a {111}<uvw>texture of no more than 13%, including grains with a tilt of up to +/−10°, when compared to the nominal crystal orientation, and a area proportion of a {100}<uvw>texture of at least 30%, including grains with a tilt of up to +/−15°, when compared to the nominal crystal orientation.

14. A method according to claim 1, wherein the heating rate over at least a temperature range from 900° C. to $T_1$ is 10 K/h to 1000 K/h, and the cooling rate over at least a temperature range from $T_1$ to 900° C. is 10K/h to 200 K/h.

15. A method according to claim 1, wherein after heat treating the preliminary products are:

stuck together by means of an insulating adhesive to form a laminated core or surface-oxidised to provide an insulating layer and then stuck or laser welded together to form a laminated core, or coated with an inorganic-organic hybrid coating and then processed further to form a laminated core.

16. A method according to claim 7, wherein after the cooling of the preliminary product to a temperature $T_2$, where $T_2$ is below $T_{\alpha/\alpha+\gamma}$, the preliminary product is held at temperature $T_2$ for a period of time $t_2$, and only then cooled further.

* * * * *